US007498107B2

(12) United States Patent
Takegawa

(10) Patent No.: US 7,498,107 B2
(45) Date of Patent: Mar. 3, 2009

(54) ELECTROPHOTOGRAPHIC PHOTORECEPTOR, PROCESS CARTRIDGE, AND IMAGE FORMING APPARATUS

(75) Inventor: Ichiro Takegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 514 days.

(21) Appl. No.: 11/236,816

(22) Filed: Sep. 28, 2005

(65) Prior Publication Data

US 2006/0140648 A1 Jun. 29, 2006

(30) Foreign Application Priority Data

Dec. 24, 2004 (JP) ..... 2004-374046

(51) Int. Cl.
*G03G 15/00* (2006.01)

(52) U.S. Cl. ..... 430/56; 399/12; 399/159

(58) Field of Classification Search ..... 430/56; 399/12, 159

See application file for complete search history.

(56) References Cited

U.S. PATENT DOCUMENTS 5,600,408 A * 2/1997 Horiuchi et al. ..... 399/39
6,789,795 B2 9/2004 Kallin et al.
7,177,552 B2 * 2/2007 Koike ..... 399/12
2003/0124445 A1 7/2003 Sugimura et al.

FOREIGN PATENT DOCUMENTS

| | | |
|---|---|---|
| CN | 1 428 662 A | 7/2003 |
| JP | A 7-271136 | 10/1995 |
| JP | A 10-186972 | 7/1998 |
| JP | A-10-339976 | 12/1998 |
| JP | A-11-030893 | 2/1999 |
| JP | A-2003-337459 | 11/2003 |
| JP | A 2004-20910 | 1/2004 |

* cited by examiner

*Primary Examiner*—John L Goodrow
(74) *Attorney, Agent, or Firm*—Oliff & Berridge, PLC

(57) ABSTRACT

An electrophotographic photoreceptor includes: a conductive supporting member; a photosensitive layer that is disposed on the conductive supporting member; and a non-contact IC tag that retains inspection information including a previously measured characteristic parameter of the photosensitive layer.

6 Claims, 13 Drawing Sheets

ELECTROPHOTOGRAPHIC PHOTORECEPTOR, PROCESS CARTRIDGE, AND IMAGE FORMING APPARATUS

BACKGROUND OF THE INVENTION

1. Field of the Invention

The present invention relates to an electrophotographic photoreceptor, a process cartridge and an image forming apparatus used in electrophotographic image formation.

2. Description of the Related Art

As enabling high-speed and high-quality printing, electrophotography is utilized in an image forming apparatus such as duplicator, laser printer, LED printer. An electrophotographic photoreceptor having a photosensitive layer of a photoconductive material formed on a conductive supporting member is known for use in such an image forming apparatus.

For repeatedly and stably forming images of good quality in such an image forming apparatus, it is necessary to control the image-forming condition including charge current, exposure level and development bias in image formation within a suitable range. The image-forming condition is set in accordance with the characteristics of the electrophotographic photoreceptor to be mounted on the image forming apparatus.

Even though produced in the same manner, photoreceptors may vary in their quality in different lots, and owing to the fluctuation of the photoreceptor quality, images formed may also vary in their quality. For example, even when an image-forming condition suitable to a photoreceptor is set, there may be a possibility that the condition may be unsuitable when the photoreceptor is exchanged for a photoreceptor in a different lot, and therefore a problem may occur in that high-quality images could not always be formed stably.

On the other hand, for example, when the design of the photoreceptor used in a processing line is changed for some reason and when the photoreceptor used therein is exchanged for the newly-designed one, then there may occur a problem in that images of good quality could not be formed since the sensitivity and the charging condition of the exchanged photoreceptor differ from those of the formerly-used one and therefore the image-forming condition for the formerly-used photoreceptor could not directly apply to the exchanged one.

When the sensitivity of the photoreceptor used in a processing line has changed, then the level of exposure to be applied to the photoreceptor must be controlled. When the charge potential of the photoreceptor has changed, then the level of charge (amount of charge current) to be applied to the photoreceptor must be controlled. Further, when the background potential, potential after exposure of the photoreceptor has changed, then the development condition must be controlled. Controlling the image-forming condition thereon within an optimum range enables the image forming apparatus to form images of the best quality.

To solve the problems in that situation, an extremely complicated and expensive reconstruction of the image-forming system is indispensable, including, for example, fitting a unit for measuring the surface potential gauge of a photoreceptor to an image forming apparatus or fitting an unit for measuring the toner concentration thereto.

A cylindrical (drum-type) photoreceptor is widely known for electrophotographic image formation, but the working accuracy of the photoreceptor drum is not always satisfactory, and there may occur eccentricity from the rotary fixed axis thereof. In a color image forming apparatus in which plural photoreceptor drum units are disposed in tandem, each drum attains different color image formation and the resulting images are combined to form a color image, the eccentricity from the rotary fixed axis of the photoreceptor drum unit causes color unevenness in combining the individual color images.

To reduce the color unevenness as much as possible, a registration technique has heretofore been investigated, which includes shifting the direction of eccentricity of each photoreceptor drum unit to the same position on the image plane thereof. Examples of such conventional technique are disclosed in JP-A-10-339976, JP-A-11-030893, and JP-A-2003-337459 (U.S. Pat. No. 6,789,795).

However, the registration technique requires unifying the direction of eccentricity by hand in disposing the photoreceptor drums. Therefore, for example, when a photoreceptor is exchanged for a different one, then it may cause a problem in that an image defect such as color unevenness may occur so far as the registration is not again effected by hand. In addition, there may be another problem in that repeated image formation may cause phase shifting of the individual photoreceptor drums and therefore images of good quality could not be stably formed.

SUMMARY OF THE INVENTION

The present invention has been made to address the above-described technical problems.

According to an aspect of the invention, there is provided an electrophotographic photoreceptor including: a conductive supporting member; a photosensitive layer that is disposed on the conductive supporting member; and a non-contact IC tag that retains inspection information including a previously measured characteristic parameter of the electrophotographic photoreceptor.

DETAILED DESCRIPTION OF THE INVENTION

Embodiments of the invention are described in detail hereinunder optionally with reference to the drawings attached hereto. In the following description, the same reference is given to the same or the corresponding part, and an overlapping description for it is omitted.

Electrophotographic Photoreceptor

Figure 1:
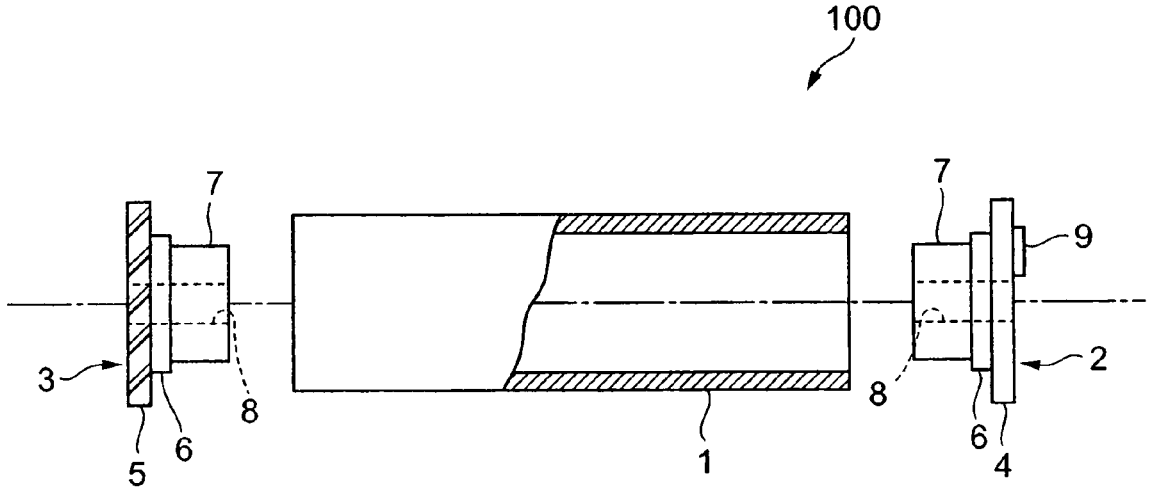
FIG. 1 is an exploded view showing one embodiment of the electrophotographic photoreceptor.

FIG. 1 is an exploded view showing an embodiment of the electrophotographic photoreceptor. As shown in FIG. 1, the electrophotographic photoreceptor 100 includes a cylindrical photoreceptor drum 1, and flanges 2 and 3 fitted to the opening at each end of the photoreceptor drum 1. An IC tag (non-contact IC tag) 9 is attached to the flange 2. The members constituting the electrophotographic photoreceptor 100 are described below.

Figure 2A:
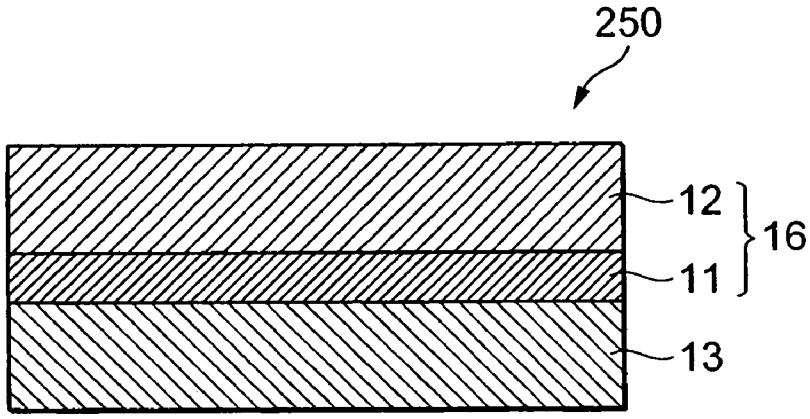
FIGS. 2A-2C are schematic cross-sectional views showing one example of a photoreceptor drum.

The photoreceptor drum 1 is first described. The photoreceptor 1 includes a cylindrical conductive supporting member and a photosensitive layer disposed on the conductive supporting member. FIG. 2A is a schematic cross-sectional view showing one example of the photoreceptor drum 1. The photoreceptor drum 250 of FIG. 2A is a function-separated photoreceptor (or a laminated-type photoreceptor), in which the photosensitive layer 16 includes a charge generation layer 11 and a charge transportation layer 12 laminated in that order on the conductive supporting member 13.

For the conductive supporting member 13, usable are metal drums of aluminium, copper, iron, stainless, zinc, nickel or the like, or shaped plastic drums. When a metal pipe substrate is used for the conductive supporting member 13, its surface may be untreated, or may be treated by mirror face polishing, etching, anodic oxidation, rough grinding, centerless grinding, sand blasting or wet honing. For the conductive supporting member 13, also usable are pipe-like conductive plastic substrates produced by dispersing conductive fine particles such as carbon black particles, metal powder or metal oxide particles in a binder resin followed by shaping the resulting dispersion by the use of a centrifugal molding or extrusion molding machine.

The charge generating layer 11 may be formed through vacuum deposition of a charge-generating material on the conductive supporting member 13, or by dispersing a charge-generating material in a binder resin along with an organic solvent to prepare a coating dispersion followed by applying the coating dispersion onto the conductive supporting member 13.

For the charge-generating material, usable are inorganic photoconductors such as amorphous selenium, crystalline selenium, selenium-tellurium alloy, selenium-arsenic alloy, other selenium compounds and selenium alloys, amorphous silicon, cadmium sulfide, and those sensitized with dye; and various organic pigments and dyes such as various phthalocyanine pigments, e.g., metal-free phthalocyanine, titanylphthalocyanine, copper phthalocyanine, tin phthalocyanine, gallium phthalocyanine, as well as naphthalocyanine pigments, squarylium pigments, anthanthrone pigments, perylene pigments, azo pigments, trisazo pigments, anthraquinone pigments, pyrene pigments, pyrylium salts, thiapyrylium salts. These organic pigments generally have some different crystal forms. In particular, phthalocyanine pigments are known to have various crystal forms such as α-form and β-form. Any of these crystal forms are usable herein so far as the pigments may bring about sensitivity and other characteristics necessary for the purpose.

In the invention, compounds mentioned below are especially favorable for the charge-generating material as they have good properties. Specifically, hydroxygallium phthalocyanine, of which one typical crystal form has diffraction peaks at a Bragg angle (2θ±0.20) of at least 7.6°, 10.0°, 25.2° and 28.0° in the X-ray diffraction spectrum thereof with a Cukα ray; chlorogallium phthalocyanine, of which one typical crystal form has diffraction peaks at a Bragg angle (2q±0.2°) of at least 7.3°, 16.5°, 25.4° and 28.1° in the X-ray diffraction spectrum thereof with a Cukα ray; and titanylphthalocyanine, of which one typical crystal form has diffraction peaks at a Bragg angle (2θ±0.2°) of at least 9.5°, 24.2° and 27.3° in the X-ray diffraction spectrum thereof with a Cukα ray are favorable for the charge-generating material. Depending on their crystal form and the method for analyzing them, these materials may give peaks that are slightly shifted from the above-mentioned peak data, but it may be judged that the materials having substantially the same X-ray diffraction pattern may have the same crystal form.

Examples of the binder resin for the charge-generating layer 11 are mentioned below. The binder resin includes, for example, polycarbonate resin such as bisphenol A-type or bisphenol Z-type resin, and its copolymer; and polyarylate resin, polyester resin, methacrylic resin, acrylic resin, polyvinyl chloride resin, polystyrene resin, polyvinyl acetate resin, styrene-butadiene copolymer resin, vinylidene chloride-acrylonitrile copolymer resin, vinyl chloride-vinyl acetate-maleic anhydride resin, silicone resin, silicone-alkyd resin, phenol-formaldehyde resin, styrene-alkyd resin, poly-N-vinylcarbazole.

One or more these binder resins may be used herein either singly or as combined. The blend ratio (by weight) of the charge-generating material to the binder resin preferably falls between 10/1 and 1/10. The organic solvent is not specifically defined so far as it dissolve or disperse the above-mentioned binder resin therein. For example, it includes methanol, ethanol, n-butanol, benzyl alcohol, acetone, methyl ethyl ketone, cyclohexanone, methyl acetate, n-butyl acetate, dioxane, tetrahydrofuran, methylene chloride, chloroform, toluene, xylene, chlorobenzene, dimethylformamide, dimethylacetamide, water. One or more of these may be used herein either singly or as combined.

The dispersion of the charge-generating material, the binder resin and the organic solvent may be attained by the use of a sand mill, a colloid mill, an attritor, a Dyno mill, a jet mill, a co-ball mill, a roll mill, an ultrasonic disperser, a Gaulin homogenizer, a microfluidizer, an ultimizer, a milder.

For applying the coating dispersion to the support, employable is any of a dipping method, a ring-coating method, a spraying method, a bead-coating method, a blade-coating method, a roller-coating method, a knife-coating method or a curtain-coating method, depending on the shape and the use of the photoreceptor. Preferably, the coated support is dried to the touch at room temperature and then dried under heat. The heat drying is preferably effected at a temperature of from 30° C. to 200° C. for from 5 minutes to 2 hours.

The thickness of the charge-generating layer is generally from 0.01 to 5.0 μm, preferably from 0.05 to 2.0 μm.

The charge-transporting layer 12 may be formed by dispersing a charge-generating material in a binder resin along with an organic solvent to prepare a coating dispersion followed by applying the coating dispersion onto the charge-generating layer 11.

Examples of the charge-transporting material for the charge-transporting layer 12 are mentioned below. They are hole-transporting materials, for example, oxadiazole derivatives such as 2,5-bis(p-diethylaminophenyl)-1,3,4-oxadiazole; pyrazoline derivatives such as 1,3,5-triphenylpyrazoline, 1-[pyridyl-(2)]-3-(p-diethylaminostyryl)-5-(p-diethylaminostyryl)pyrazoline; aromatic tertiary amino compounds such as triphenylamine, tri(p-methyl)phenylamine, N,N-bis(3,4-dimethylphenyl)biphenyl-4-amine, dibenzylaniline, 9,9-dimethyl-N,N-di(p-tolyl)fluorenone-2-amine; aromatic tertiary diamino compounds such as N,N'-diphenyl-N,N'-bis(3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2-methyl-1-indolinylimino)methyl]carbazole, 4-(2-methyl-1-indolinyliminomethyl)triphenylamine, 9-methyl-3-carbazole-diphenylhydrazone, 1,1-di-(4,4'-methoxyphenyl)acrylaldehyde-diphenylhydrazone, β,β-bis(methoxyphenyl)vinyldiphenylhydrazone; quinazoline derivatives such as 2-phenyl-4-styrylquinazoline; benzofuran derivatives such as 6-hydroxy-2,3-di(p-methoxyphenyl)benzofuran; a-stilbene derivatives such as p-(2,2-diphenylvinyl)-N,N-diphenylaniline; enamine derivatives; carbazole derivatives such as N-ethylcarbazole; and poly-N-vinylcarbazole and its derivatives; electron-transporting materials, for example, quinone compounds such as chloranil, bromoanile, anthraquinone; tetracyanoquinodimethane compounds; fluorenone compounds such as 2,4,7-trinitrofluorenone, 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole; xanthone compounds; thiophene compounds; diphenoquinone compounds such as 3,3',5,5'-tetra-t-butyldiphenoquinone, 3,5-dimethyl-3',5'-di-t-butyl-4,4'-diphenoquinone; and polymers having a group of the above-mentioned compounds in the backbone chain or side branch thereof. One or more of these charge-transporting materials may be used herein either singly or as combined.

Regarding the laminated-type photoreceptor, the charge polarity of the photoreceptor varies depending on the charge transportation polarity of the charge-transporting material therein. When a hole-transporting material is used therein, then the photoreceptor is used as negative charge; but when an electron-transporting material is used, then it is used as positive charge. When the two are mixed and used herein, the photoreceptor enables negative/positive charge polarity.

The binder resin to be used in the charge-transporting layer 12 may be any one, but is preferably one having compatibility with the charge-transporting material and having a suitable strength. The binder resin of the type includes, for example, various polycarbonate resins and their copolymers including bisphenol A, bisphenol Z, bisphenol C or bisphenol TP; polyarylate resins and their copolymers; polyester resins, methacrylic resins, acrylic resins, polyvinyl chloride resins, polyvinylidene chloride resins, polystyrene resins, polyvinyl acetate resins, styrene-butadiene copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene-acryl copolymer resins, styrene-alkyd resins, poly-N-vinylcarbazole resins, polyvinylbutyral resins, polyphenylene-ether resins. One or more these resins may be used herein either singly or as combined.

Including the structures mentioned above, various modifications of polycarbonate resins are usable herein. In particular, those having repetitive units of the following general formula (1) are preferred for use herein.

(1)

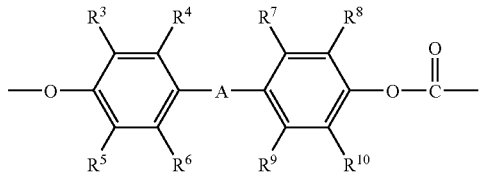

In formula (1), A represents —$CR^1R^2$—, an alkylene group, —O—, —S—, —SO—, or —$SO_2$—; $R^1$, $R^2$, $R^3$, $R^4$, $R^5$, $R^6$, $R^7$, $R^8$, $R^9$ and $R^{10}$ (hereinafter these are abbreviated to "$R^1$ to $R^{10}$") each independently represent a hydrogen atom, a halogen atom, an alkyl group, or a cyclic hydrocarbon group. $R_1$ and $R_2$ may bond to each other to form a cyclic hydrocarbon group. The alkylene group for A may have a substituent, including, for example, a methylene group, an ethylene group, a trimethylene group, and a tetramethylene group.

The alkyl group for $R^1$ to $R^{10}$ may have a substituent, and is preferably a linear alkyl group having from 1 to 12 carbon atoms or a branched alkyl group having from 3 to 12 carbon atoms, to which, however, the group should not be limited. Concretely, the group includes a methyl group, an ethyl group, a propyl group, a butyl group, a pentyl group, a hexyl group, a heptyl group, an octyl group, a nonyl group, a decyl group, an undecyl group, a dodecyl group, a tridecyl group, a hexadecyl group, an octadecyl group, an eicosyl group, an isopropyl group, an isobutyl group, an s-butyl group, a t-butyl group, an isopentyl group, a neopentyl group, a 1-methylbutyl group, an isohexyl group, a 2-ethylhexyl group, a 2-methylhexyl group, a 2-norbornyl group.

The cyclic hydrocarbon group for $R^1$ to $R^{10}$ may have a substituent, and is preferably a cyclic hydrocarbon group having from 3 to 10 carbon atoms, to which, however, the group should not be limited. Concretely, the group includes a cyclopropyl group, a cyclobutyl group, a cyclopentyl group, a cyclohexyl group, a cycloheptyl group, a phenyl group, a tolyl group, a xylyl group.

The polycarbonate resin for use herein may have a copolymer structure including a plurality of these components combined.

Similarly, various modifications of polyarylate resins are also usable herein. Preferred for use herein are those having repetitive units of the following general formula (2), in which A, and $R^1$ to $R^{10}$ have the same meanings as those in formula (1). The polyarylate resin for use herein may have a copolymer structure including a plurality of these components combined.

(2)

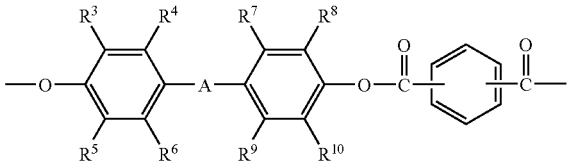

The molecular weight of the polymer used as the binder resin may be suitably selected, depending on the film-forming condition including the thickness of the photosensitive layer and the solvent used. Preferably, the viscosity-average molecular weight of the polymer is from 3,000 to 300,000, more preferably from 20,000 to 200,000.

The charge-transporting layer 12 may be formed by applying a coating solution, which is prepared by dispersing the charge-transporting material and the binder resin in a suitable solvent, onto the charge-generating layer 11 followed by drying it. The solvent used in forming the charge-transporting layer 12 includes, for example, aromatic hydrocarbons such as benzene, toluene, chlorobenzene; ketones such as acetone, 2-butanone; halogenated aliphatic hydrocarbons such as methylene chloride, chloroform, ethylene chloride; cyclic or linear ethers such as tetrahydrofuran, dioxane, ethylene glycol, diethyl ether; and their mixed solvents. For improving the surface smoothness of the coating film, a minor amount of a leveling agent, silicone oil may be added to the coating dispersion. The blend ratio (by weight) of the charge-transporting material to the binder resin preferably falls between 10/1 and 1/5.

The dispersion of the charge-transporting material, the binder resin and the organic solvent may be attained by the use of a sand mill, a colloid mill, an attritor, a Dyno mill, a jet mill, a co-ball mill, a roll mill, an ultrasonic disperser, a Gaulin homogenizer, a microfluidizer, an ultimizer, a milder.

For applying the coating dispersion to the underlying layer, employable is any of a dipping method, a ring-coating method, a spraying method, a bead-coating method, a blade-coating method, a roller-coating method, a knife-coating method or a curtain-coating method, depending on the shape and the use of the photoreceptor. Preferably, the coating layer is dried to the touch at room temperature and then dried under heat. The heat drying is preferably effected at a temperature of from 30° C. to 200° C. for from 5 minutes to 2 hours.

The thickness of the charge-transporting layer is generally from 5 to 50 μm, preferably from 10 to 40 μm, more preferably from 10 to 30 μm.

When the charge-transporting layer 12 is the outermost layer of the photoreceptor drum 1, then lubricant solid particles such as polytetrafluoroethylene may be added to the charge-transporting layer 12 for the purpose of improving the surface lubricity of the layer. As the fluorine-containing resin particles, it is desirable that one or more are suitably selected from tetrafluoroethylene resin, trifluorochloroethylene resin, hexafluoropropylene resin, vinyl fluoride resin, vinylidene fluoride resin, difluorodichloroethylene resin and their copolymers. More preferred are tetrafluoroethylene resin and vinylidene fluoride resin.

The content of the fluorine-containing resin particles in the charge-transporting layer 12 is suitably from 0.1 to 40% by weight, but preferably from 1 to 30% by weight based on the overall amount of the charge-transporting layer 12. If the content is smaller than 0.1% by weight, then the improving effect of the fluorine-containing resin particles dispersed in the layer may be unsatisfactory; but if larger than 40% by weight, then the light transmittance through the layer may lower and the residual potential of the layer in repeated use may increase.

Preferably, the mean primary particle size of the fluorine-containing resin particles is from 0.05 to 1 μm, more preferably from 0.1 to 0.5 μm. If the mean primary particle size is smaller than 0.05 μm, then the particles may aggregate too much in their dispersion. On the other hand, if the mean primary particle size is larger than 1 μm, then it may cause image defects.

In addition to the fluorine-containing resin particles thereto, inorganic particles may also be added to the charge-transporting layer 12.

The content of the inorganic particles in the charge-transporting layer 12 is suitably from 0.1 to 30% by weight, but preferably from 1 to 20% by weight based on the overall amount of the charge-transporting layer 12. If the content is smaller than 0.1% by weight, then the improving effect of the inorganic particles dispersed in the layer may be unsatisfactory; but if larger than 30% by weight, then the residual potential of the layer in repeated use may increase.

For the inorganic particles, for example, usable is one selected from alumina, silica (silicon dioxide), titanium oxide, zinc oxide, cerium oxide, zinc sulfide, magnesium oxide, copper sulfate, sodium carbonate, magnesium sulfate, potassium chloride, calcium chloride, sodium chloride, nickel sulfate, antimony, manganese dioxide, chromium oxide, tin oxide, zirconium oxide, barium sulfate, aluminium sulfate, silicon carbide, titanium carbide, boron carbide, tungsten carbide, zirconium carbide, and, if desired, two or more of them. Preferred is silica. Silica particles for use herein are preferably formed through chemical flame CVD. Concretely, one preferred method for forming silica particles includes reacting a chlorosilane gas in a vapor phase in a high-temperature flame of oxygen-hydrogen mixed gas or hydrocarbon-oxygen mixed gas.

Also preferably, the inorganic particles are hydrophobicated on their surface. For the hydrophobicating agent, for example, usable are siloxane compounds, silane-coupling agents, titanium-coupling agents, polymer fatty acids and their metal salts. The siloxane compounds include polydimethylsiloxane, dihydroxypolysiloxane, octamethylcyclotetrasiloxane; and the silane-coupling agents include γ-(2-aminoethyl)aminopropyltrimethoxysilane, γ-(2-aminoethyl) aminopropyldimethyldimethoxysilane, g-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane.

The mean primary particle size of the inorganic particles is preferably from 0.005 to 2.0 μm, more preferably from 0.01 to 1.0 μm. If the mean primary particle size of the inorganic particles is smaller than 0.005 μm, then the surface of the photoreceptor could not have a satisfactory mechanical strength, and the particles may aggregate too much in their dispersion. On the other hand, if the size is larger than 2 μm, then the surface roughness of the photoreceptor may increase and, as a result, the cleaning blade used may be worn and damaged and the cleaning characteristic may worsen, and therefore the images formed may blur.

For dispersing the fluorine-containing resin particles and the inorganic particles in the charge-transporting layer 12, usable is a media-associated disperser such as ball mill, shaking ball mill, attritor, sand mill, horizontal sand mill; and a mediumless disperser such as stirrer, ultrasonic disperser, roll mill, high-pressure homogenizer. The high-pressure homogenizer may be a collision type in which a dispersion is subjected to liquid-liquid collision or liquid-wall collision under high pressure, or a through-run type in which a dispersion is made to run through fine paths under high pressure.

For preparing the coating dispersion of such fluorine-containing resin particles or inorganic particles to form the charge-transporting layer 12, employable is a method of dispersing the fluorine-containing resin particles or the inorganic particles in a solution prepared by dissolving a binder resin and a charge-transporting material in a solvent.

For improving the dispersion stability of the coating dispersion and for preventing aggregation in film formation, a small amount of a dispersion assistant may be effectively added to the coating dispersion. The dispersion assistance includes fluorine-containing surfactant, fluorine-containing polymer, silicone polymer, and silicone oil. Of those, preferred is fluorine-containing polymer, and more preferred is fluorine-containing comb-grafted polymer as the dispersion assistant. The fluorine-containing comb-grafted polymer is preferably prepared by graft-polymerizing a macromonomer of acrylate compounds, methacrylate compounds or styrene compounds, with a perfluoroalkylethyl methacrylate.

For preventing the photoreceptor from being deteriorated by ozone or oxidizing gas generated in the image forming apparatus or by light or heat, additives such as antioxidant, light stabilizer or heat stabilizer may be added to the photosensitive layer 16 that includes the charge-generating layer 11 and the charge-transporting layer 12.

The antioxidant includes, for example, hindered phenols, hindered amines, paraphenylenediamine, arylalkanes, hydroquinone, spirochroman, spiroindanone, and their derivatives, organosulfur compounds, and organophosphorus compounds.

Examples of the antioxidant compounds are mentioned. The phenolic antioxidants include 2,6-di-t-butyl-4-methylphenol, styrenic phenol, n-octadecyl 3-(3',5'-di-t-butyl-4'-hydroxyphenyl)propionate, 2,2'-methylenebis(4-methyl-6-t-butylphenol), 2-t-butyl-6-(3'-t-butyl-5'-methyl-2'-hydroxybenzyl)-4-methylphenyl acrylate, 4,4'-butylidenebis-(3-methyl-6-t-butyl-phenol), 4,4'-thiobis(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxyphenyl)propionate]-methane, 3,9-bis[2-(3-t-butyl-4-hydroxy-5-methylphenyl)propionyloxy]-1,1-dimethylethyl]-2,4,8,10-tetroxaspiro[5,5]undecane, stearyl 3-3',5'-di-t-butyl-4'-hydroxyphenyl)propionate. The hindered amine compounds include bis(2,2,6,6-tetramethyl-4-piperidyl)sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl) propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diyl}{2,2,6,6-tetramethyl-4-piperidyl)imino}hexamethylene{(2,3,6,6-tetramethyl-4-piperidyl)imine}], bis(1,2,2,6,6-pentamethyl-4-piperidyl)2-(3,5-di-t-butyl-4-hydroxybenzyl)-2-n-butylmalonate, N,N'-bis(3-aminopropyl)ethylenediamine-2,4-bis[N-butyl-N-(1,2,2,6,6-pentamethyl-4-piperidyl) amino]-6-chloro-1,3,5-triazine condensate. The organosulfur antioxidants include dilauryl 3,3'-thiodipropionate, dimyristyl 3,3'-thiodipropionate, distearyl 3,3'-thiodipropionate, pentaerythritol tetrakis(β-laurylthiopropionate), ditridecyl 3,3'-thiodipropionate, 2-mercaptobenzimidazole. the organophosphorus antioxidants include trisnonylphenyl phosphate, triphenyl phosphate, tris(2,4-di-t-butylphenyl) phosphate.

Figure 2B:
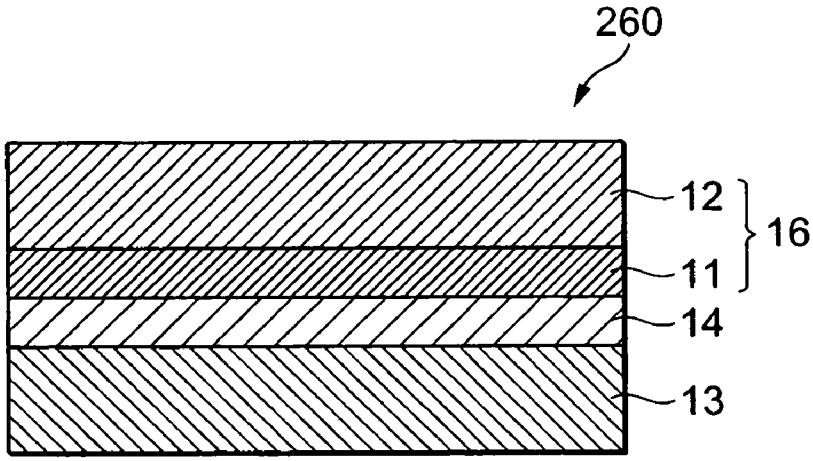

FIG. 2B is a schematic cross-sectional view showing another example of the photoreceptor drum 1. The photoreceptor 260 shown in FIG. 2B has the same configuration as that of the photoreceptor 250 shown in FIG. 2A, except that it has a subbing layer 14 between the conductive supporting member 13 and the photosensitive layer 16.

The subbing layer 14 has the function of preventing charge injection from the conductive supporting member 13 to the photosensitive layer 16 in charging the photosensitive layer 16. The subbing layer 14 also functions as an adhesive layer for integrally adhering and fixing the photosensitive layer 16 to the conductive supporting member 13. Further, the subbing layer 14 has the function of preventing light reflection on the conductive supporting member 13.

The material to constitute the subbing layer 14 includes polymer resin compounds, for example, acetal resin such as polyvinyl butyral, and polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, melamine resin; and organic metal compounds containing a zirconium, titanium, aluminium, manganese or silicon atom. One or more of these compounds may be used herein, singly or as a mixture or polycondensate thereof. Of those, organic metal compounds containing zirconium or silicon are preferred in point of their property in that their residual potential is low, their potential change depending on the environment is small, and their potential change in repeated use is also small.

In the subbing layer 14, a metal oxide having a suitable resistance value may be dispersed in the resin, thereby suitably controlling the resistance value of the coating film, preventing the residual charge from accumulating on the film and keeping a predetermined film thickness, and the leak resistance of the photoreceptor, especially the leak resistance in contact charging thereof may be improved. This is referred to as a dispersion-type subbing layer. In this case, a resistance-controlling agent may be dispersed in the layer, and the film thickness of the layer may be increased than that of the above-mentioned configuration. The layer of the type may have a larger thickness when used herein.

One example of the dispersion-type subbing layer may be formed by dispersing a conductive substance, for example, a metal powder such as aluminium copper, nickel or silver, a conductive metal oxide such as antimony oxide, indium oxide, tin oxide or zinc oxide, or carbon fibers, carbon black or graphite powder, in a binder resin and applying the resulting dispersion onto the support 13.

The conductive metal oxide is preferably particles having a mean primary particle size of at most 0.5 μm. The subbing layer 14 must have a suitable resistance in order to have leak resistance, for which the metal oxide particles preferably have a powder resistance of from $10^2$ to $10^{11}$ Ω·cm or so. Above all, preferred for use herein are metal oxide particles of tin oxide, titanium oxide or zinc oxide having a powder resistance that falls within the above-mentioned range. If the powder resistance of the metal oxide particles is smaller than the lowermost value of the range, then the layer could not have sufficient leak resistance; but if larger than the uppermost value of the range, then the residual potential of the layer may increase.

Two or more different types of metal oxide particles may be combined for use herein. The metal oxide particles may be surface-treated with a coupling agent so as to control the powder resistance thereof. The coupling agent usable for it includes, for example, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, γ-chloropropyltrimethoxysilane, to which, however, the agent should not be limited. Two or more of such coupling agents may be used as combined.

For the binder resin for the dispersion-type subbing layer, usable are known polymer resin compounds including acetal resin such as polyvinyl butyral, polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenolic resin, phenol-formaldehyde resin, melamine resin, urethane resin; and conductive resins such as charge-transporting group-having charge-transporting resin and polyaniline. Of those, preferred are resins insoluble in the coating solvent for the upper layer; and especially preferred are phenolic resin, phenol-formaldehyde resin, melamine resin, urethane resin, and epoxy resin.

The ratio of the metal oxide particles to the binder resin in the dispersion-type subbing layer-forming coating liquid may be suitably defined within a range within which desired electrophotographic photoreceptor characteristics can be obtained.

Figure 2C:
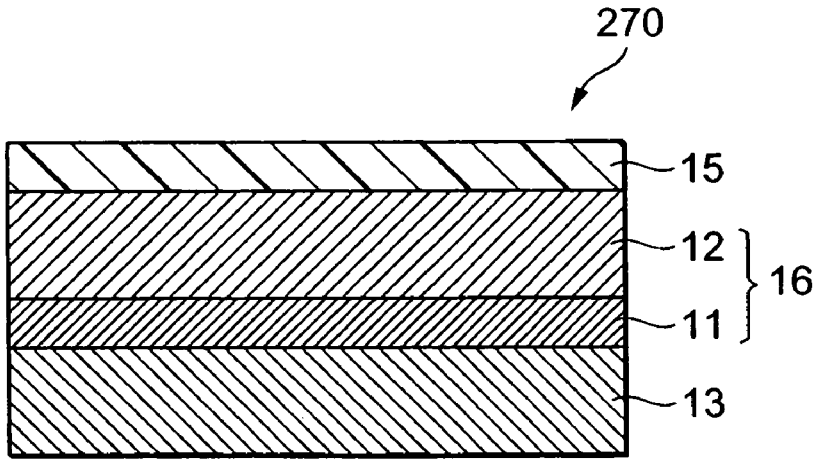

FIG. 2C is a schematic cross-sectional view showing still another example of the photoreceptor drum 1. The photoreceptor 270 shown in FIG. 2C has the same configuration as that of the photoreceptor 250 shown in FIG. 2A, except that it has a protective layer (surface-protective layer) 15 on photosensitive layer 16 (on the side of the photosensitive layer 16 remoter from the conductive supporting member 13).

The protective layer 15 is provided for the purpose of improving the abrasion resistance of the abrasion resistance of the photoreceptor drum 280, prolonging the photoreceptor life, improving the matching capability with developer, and preventing chemical deterioration of the charge-transporting layer 12 in charging the photoreceptor drum 280.

Examples of the protective layer 15 are an insulating resin layer; a charge-transporting protective layer formed of a charge-transporting polymer compound; and a resistance-controlling surface-protective layer with resistance-controlling particles of metal oxide dispersed therein.

In the resistance-controlling surface-protective layer with resistance-controlling particles dispersed therein, carbon black, metal or metal oxide may be used for the resistance-controlling particles. The metal oxide includes titanium oxide, zinc oxide, tin oxide, antimony oxide-coated tin oxide, silicon oxide, iron oxide, aluminium oxide, cerium oxide, yttrium oxide, silicon oxide, zirconium oxide, magnesium oxide, copper oxide, manganese oxide, molybdenum oxide, tungsten oxide, solid solution of barium sulfate and antimony oxide; mixture of the above-mentioned metal oxides; mixture prepared by adding the above-mentioned metal oxide to single particles of titanium oxide, tin oxide, zinc oxide or barium sulfate; and coated particles prepared by coating single particles of titanium oxide, tin oxide, zinc oxide or barium sulfate with the above-mentioned metal oxide.

The resistance-controlling surface-protective layer may be formed by dispersing the above-mentioned resistance-controlling particles in a polymer resin compound such as acetal resin, e.g., polyvinylbutyral, or polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenolic resin, phenol-formaldehyde resin, or melamine resin, followed by forming the resulting dispersion into a film.

The amount of the resistance-controlling particles to be added to the protective layer 15 is suitably controlled so that the layer 15 could have a desired film resistance. Concretely, the volume of the resistance-controlling particles is controlled to be generally from 10 to 60% by volume, but preferably from 20 to 50% by volume based on the overall volume of the protective layer 15.

In order to prevent any conductive impurity from penetrating into the photoreceptor, it is effective that the surface-protective layer 15 is formed of a resin having a higher hardness than a predetermined level.

As containing, for example, a metal oxide having a particle size of at most 100 nm, the surface-protective layer 15 has high transparency, and even though it is thick, its sensitivity decreases little since its transmittance lowers little. Accordingly, since the layer has good abrasion resistance and may be thick, the life of the photoreceptor may be further prolonged.

Apart from those mentioned above, other known resins such as epoxy resin, polyketone resin, polycarbonate resin, polyvinyl ketone resin, polystyrene resin, polyacrylamide resin, polyimide resin, polyamidimide resin are also usable for the binder resin for the protective layer 15. If desired, the resins may be crosslinked for use herein.

Preferably, the thickness of the protective layer 15 is from 0.1 to 20 μm, more preferably from 1 to 10 μm. The protective layer 15 may be formed in any ordinary coating method of blade coating, wire bar coating, spraying, dipping, ring coating, bead coating, air knife coating or curtain coating.

For the solvent for the coating liquid for forming the protective layer 15, usable are any ordinary organic solvents such as dioxane, tetrahydrofuran, methylene chloride, chloroform, chlorobenzene, toluene, alcohol, either singly or as combined. Preferably, the solvent dissolves as little as possible the photosensitive layer 16 to which the coating liquid is applied.

A charge-transporting polymer agent prepared by modifying a polymer component so as to make it have a charge-transporting function, or a charge-transporting resin component prepared by dispersing a low-molecular charge-transporting agent in a tough coating agent such as a silicone hard coating agent in a mode of molecular dispersion may be used in the protective layer 15. One example of the surface-protective layer that contains such a charge-transporting polymer component is a surface-protective layer that includes a silicone polymer with a functional group of a charge-transporting material introduced thereinto.

Figure 3A:
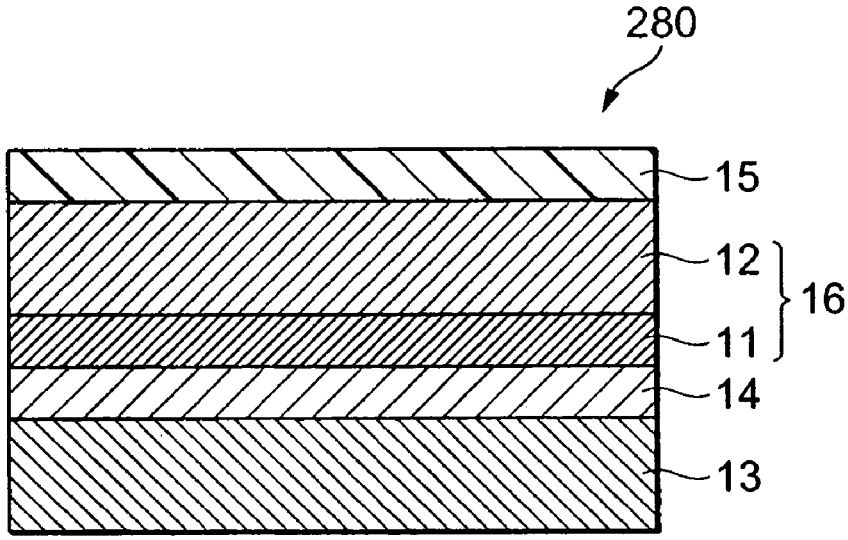
FIGS. 3A and 3B are schematic cross-sectional views showing one example of a photoreceptor drum.

Preferred examples of the photoreceptor drum 1 are described in detail hereinabove, but the photoreceptor drum 1 should not be limited to FIG. 2A to 2C. For example, it may also be the photoreceptor drum 280 shown in FIG. 3A, which includes a subbing layer 14 between the conductive supporting member 13 and the photosensitive layer 16 and which has a protective layer 15 on the photosensitive layer 16.

Figure 3B:
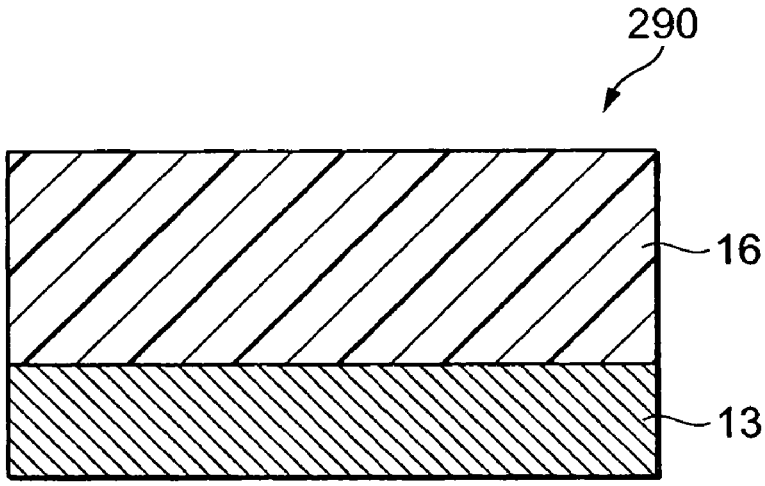

In the above-mentioned examples of the photoreceptor drum 1, the photosensitive layer 16 has a two-layered structure, to which, however, the invention should not be limited. The photosensitive layer 16 may have a single-layered structure, for example, as in the photoreceptor drum 290 shown in FIG. 3B. In this case, the photosensitive layer 16 contains both the charge-generating material and the charge-transporting material mentioned hereinabove. Though not shown in FIG. 3B, a subbing layer 14 may be disposed between the conductive supporting member 13 and the photosensitive layer 16, a protective layer 15 may be formed on the photosensitive layer 16, or both the subbing layer 14 and the protective layer 15 may be disposed.

The flanges 2 and 3 to be fitted to the end opening of the photoreceptor drum 1 are described below.

The flanges 2 and 3 are generally formed to have a desired shape by the use of a mold. As shown in FIG. 1, the flange 2 includes a cylindrical fitting part 6 that is to be fitted into the end opening of the photoreceptor drum 1; a cylindrical outer part 4 integrated with the fitting part 6; and a weight part 7 integrated with the fitting part 6. In the center of the flange 2, formed is a through-hole 8 that runs through the fitting part 6, the outer part 4 and the weight part 7 for inserting a shaft thereinto. The flange 3 has the same configuration as that of the flange 2, except that the cylindrical outer part thereof integrated with the fitting part 6 is so modified as to have a gear in its outer periphery and it is a gear part 5. If desired, the flange 3 may have a position guide.

An IC tag 9 is stuck to the outer part 4 of the flange 2, on the side thereof opposite to the photoreceptor drum 1. In this case, the position at which the IC tag 9 is to be fitted to the outer part 4 must be so controlled that it causes no problem in fitting the flange 2 into the photoreceptor drum 1 and in image formation by the use of the electrophotographic photoreceptor 100. Accordingly, it is desirable that a fitting space is previously provided in the surface of the outer part 4, at a position therein at which the IC tag 9 is to be fitted to the outer part 4, whereby the IC tag can surely be fitted to outer part 4 at the determined position thereof. The IC tag 9 may be directly stuck to the surface of the outer part 4, for example, with an adhesive. Alternatively, an adhesive sheet including the IC tag 9 may be used, and the adhesive sheet may be stuck to the surface of the outer part 4 whereby the IC tag 9 may be stuck to the outer part 4.

In the electrophotographic photoreceptor 100 in FIG. 1, the IC tag 9 is fitted to the flange 2 on the side thereof opposite to the photoreceptor drum 1, but the position of the IC tag 9 is not limited to the illustrated one. For example, the IC tag 9 may be fitted to the inner surface of the photoreceptor drum 1, or that is, to the surface of the conductive supporting member 13 (on the side opposite to that with the photosensitive layer 16 formed thereon). When the IC tag 9 is fitted to the flange, it may be fitted to any of flanges 2 and 3, or a recessing area in which the IC tag 9 may be disposed may be formed inside the flange and the IC tag 9 may be fitted to it. Further, when the flange is formed in a mode of injection molding, then the IC tag 9 may be buried in the flange during the injection molding process.

On the IC tag 9, written is inspection information about predetermined characteristic parameters previously measured relative to the electrophotographic photoreceptor 100, preferably inspection information about a reference position on the peripheral surface of the photoreceptor 100 and about the predetermined characteristic parameters at a predetermined position. That is, the IC tag 9 retains the inspection information including previously measured characteristic parameters of the electrophotographic photoreceptor 100. The predetermined characteristic parameters are previously measured relative to the photoreceptor 100, concretely including, for example, the film thickness, the charging characteristic, the I-V characteristic, the dark decay characteristic, the sensitivity, the surface roughness, the light reflectance and the direction of eccentricity of the photosensitive layer 16. Not limited to these, however, the characteristic parameters may include any other items. Further, not limited to the reference position and the characteristic parameters mentioned above, the inspection information may include any other information relating to any other items than those mentioned above.

The inspection information may be determined by an inspection device capable of determining various inspection information data in the condition of the photoreceptor drum 1 as it is or in the condition of the photoreceptor drum 1 with the flanges 2 and 3 fitted into both its end openings. For example, the items for evaluation of characteristic parameters relating to the electric characteristics of the photoreceptor drum 1 include the charging characteristic, the I-V characteristic, the dark decay characteristic and the sensitivity of the photoreceptor drum 1, and these may be measured by the use of an inspection device such as a universal measuring device to which the photoreceptor drum 1 is fitted so as to measure the electric characteristics of the drum 1. The data thus measured by the inspection device is registered in the computer of the inspection device as the inspection information, and then this is recorded on the IC tag 9 via the computer. After the inspection information is written on the IC tag 9, the IC tag 9 may be fitted to the photoreceptor drum 1; or the IC tag 9 may be previously fitted to the photoreceptor drum 1 before the measurement, and then the measured inspection information may be written on the IC tag 9 on the photoreceptor drum 1.

Figure 4:
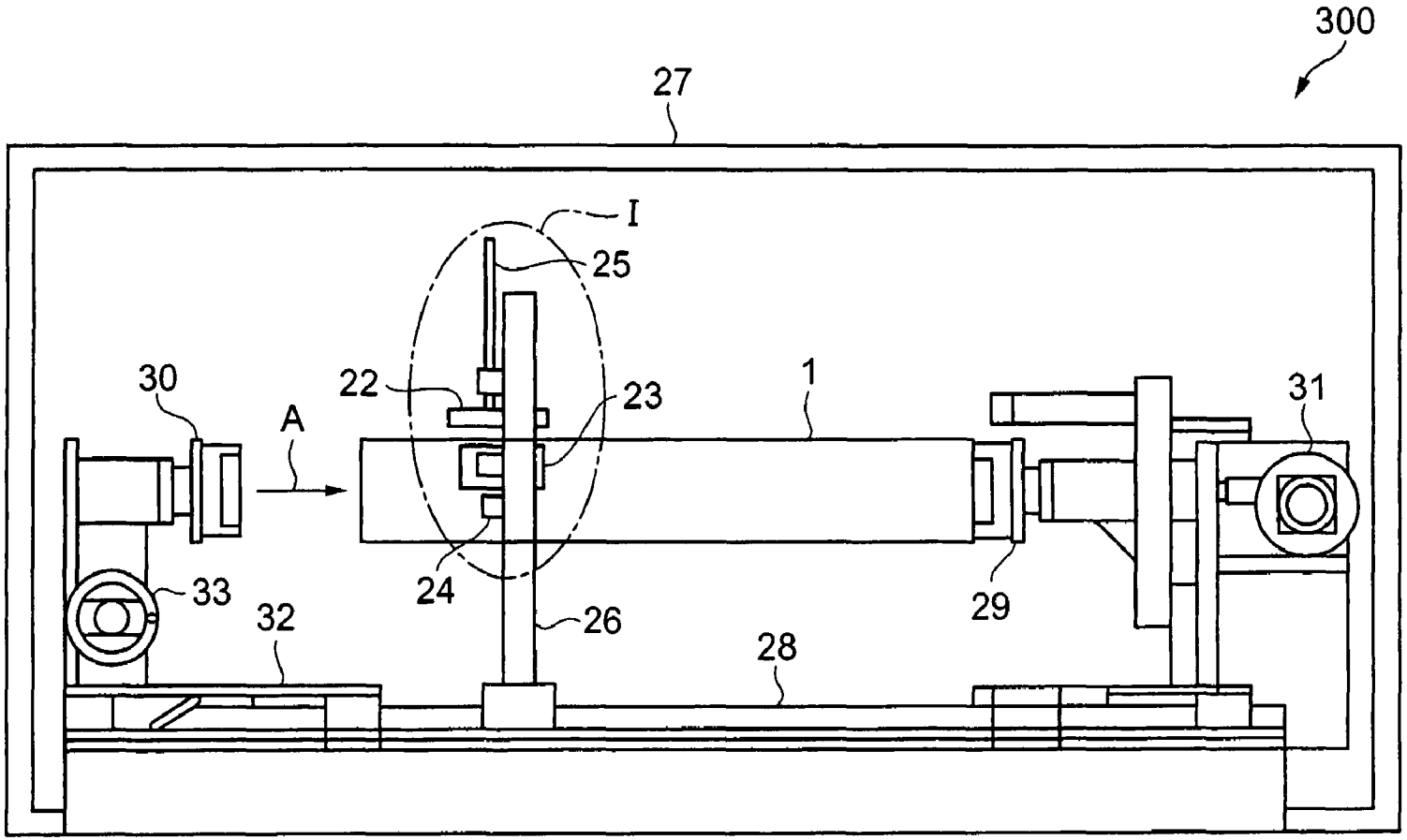
FIG. 4 is a view showing one example of a device for inspection of electric characteristics.
Figure 5:
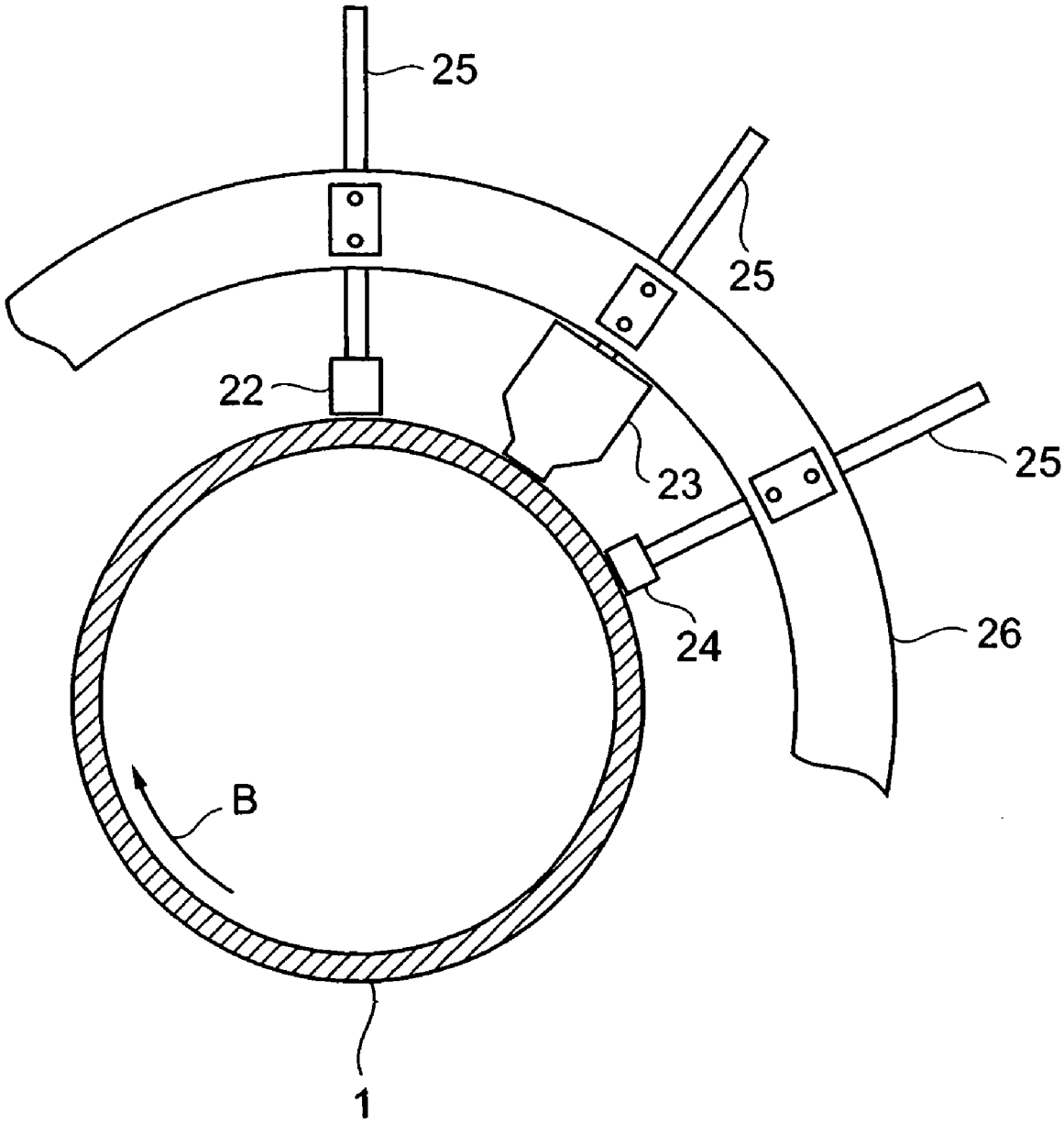
FIG. 5 is a partly-enlarged cross-sectional view of the part I of the electric characteristic inspection device shown in FIG. 4.

FIG. 4 is one example showing a device for inspection of electric characteristics. FIG. 5 is a partly-enlarged cross-sectional view of the part I of the electric characteristic inspection device shown in FIG. 4. As in FIGS. 4 and 5, the photoreceptor drum 1 is set in the housing 27 of the inspection device 300, and a charger 22, an exposure unit 23 and a potential measurement probe 24 are set around the photoreceptor drum 1 via a fitting tool 26. In this, one end of the photoreceptor drum 1 is fixed to a supporting arm 29. Next, a slide bed 32 with a supporting arm 30 fitted thereto is moved in the direction of the arrow A in FIG. 4 by rotating the handle 23 whereby the other end of the photoreceptor drum 1 is fixed by the supporting arm 20. The charger 22, the exposure unit and the potential measurement probe 24 are fitted to the respective supporting bars 25 at the end thereof on the side of the photoreceptor drum 1, and all the supporting bars 25 are fixed to the fitting tool 26.

In measuring the electric characteristics of the photoreceptor drum 1, the photoreceptor drum 1 is rotated in the direction of the arrow B in FIG. 5 by a motor 21, and further, the fitting tool 26 may be moved in the horizontal direction in FIG. 4 along the slide rail 28. Accordingly, in the inspection device 300, the electric characteristics of the entire peripheral surface of the photoreceptor drum 1 can be measured.

The electric characteristics of the photoreceptor drum 1 may be measured as follows: First, the photoreceptor drum 1 is charged by the charger 22, and the charging condition (charge potential, current value) in this step and the dark decay are measured. The photoreceptor drum 1 is exposed to a varying quantity of light from the exposure unit 23, and the dark decay potential is measured, whereby the sensitivity and the light decay characteristic of the drum 1 can be measured. Similarly, the I-V characteristic of the drum 1 may be measured by the use of the electric characteristic inspection device 300, with which the relationship between the current value for charging and the charge potential is determined.

The thickness of the photosensitive layer may be determined by the use of an eddy current measuring device or an optical interference-type film thickness meter, or by measuring the step difference in the film-peeled surface of the drum. The surface roughness of the photosensitive layer may be determined by the use of a probe-type surface roughness meter or a laser microscope.

The light reflectance of the photoreceptor may be determined by measuring the quantity of light reflected on the photoreceptor followed by comparing it with the quantity of light applied to the photoreceptor. The abrasion resistance of the photoreceptor may be determined as follows: An electrophotographic processor with the photoreceptor fitted therein is repeatedly used, and the film thickness change of the photoreceptor is measured. This indicates the abrasion of the coating film, from which the abrasion resistance of the photoreceptor is determined. The hardness of the photoreceptor may be measured by the use of a device such as a Knoop or Vickers hardness meter or a dynamic hardness meter.

The thus-measured inspection information is registered in the control device (e.g., computer) electrically connected to the inspection device 300. When an IC tag 9 is fitted to the photoreceptor drum 1, then the inspection information is transferred to the IC tag from the control device and is recorded thereon. When an IC tag 9 is not fitted to the photoreceptor drum 1, then the inspection information is transferred to an IC tag 9 that is to be fitted to the photoreceptor 1, and thereafter the IC tag 9 is fitted to the corresponding photoreceptor drum 9. The inspection information is registered in a quality management system as a whole, and is recorded on the IC tag 9 fitted to each photoreceptor drum 1 as the information intrinsic to it.

The inspection information may be measured for every photoreceptor drum 1, or may be standard data set through measurement of every lot or every product version. When the standard data are set for every lot or every product version, then, for example, plural drums are sampled from each lot or product version and are measured and the thus-measured values are averaged to give a standard value to be set.

Figure 6:
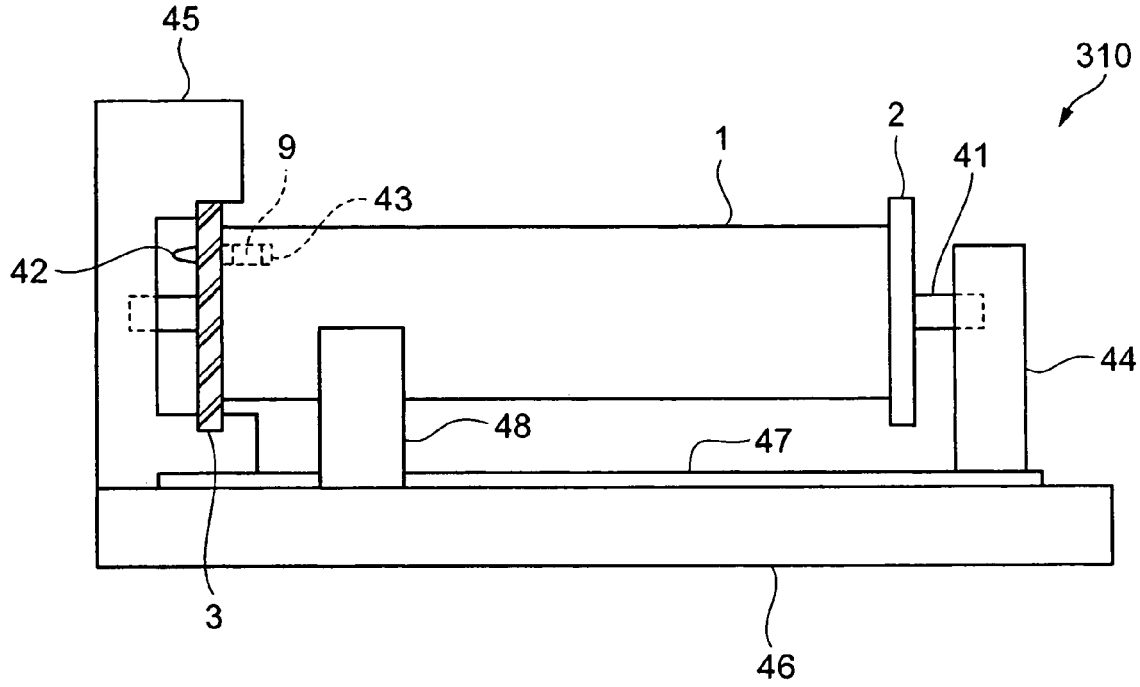
FIG. 6 is a view showing one example of an direction of eccentricity inspection device.

A method for measuring the direction of eccentricity of the photoreceptor drum 1 is described with reference to FIGS. 6 to 8. FIG. 6 is a view showing one example of an direction of eccentricity inspection device. As shown in FIG. 6, the photoreceptor drum 1 has the flange 2 and the gear part-having flange 3 fitted to the end openings thereof, and a shaft 41 is inserted to run through the center of the flanges 2 and 3. One end of the shaft 41 is fixed to the supporting member 44, and the other end thereof is fixed to the drum rotation-driving member 45. Accordingly, the photoreceptor drum 1 is fixed to the surface table 46. In the photoreceptor drum 1 in FIG. 6, a position guide 42 is fitted to the flange 3, which is for defining a reference position of the photoreceptor drum 1. A buried part 43 is formed inside the flange 3 from the position at which the position guide 42 is disposed, and an IC tag 9 is fitted inside the buried part 43. The IC tag 9 is, for example, a small IC chip having a size of at most 1 mm, and therefore the buried part 43 may be an extremely small notch and it may be buried inside the flange 3 with no protrusion.

On the surface table 46, disposed are a moving guide 47 and a laser sensor 48 movable in the horizontal direction in FIG. 6 along the moving guide 47. FIG. 7 is a partly-enlarged cross-sectional view showing the positional relationship between the laser sensor 48 and the photoreceptor drum 1. As shown in FIG. 7, the laser sensor 48 has a laser-radiating part 49 and a laser-receiving part 50, and the photoreceptor drum 1 is disposed between the two.

Figure 7:
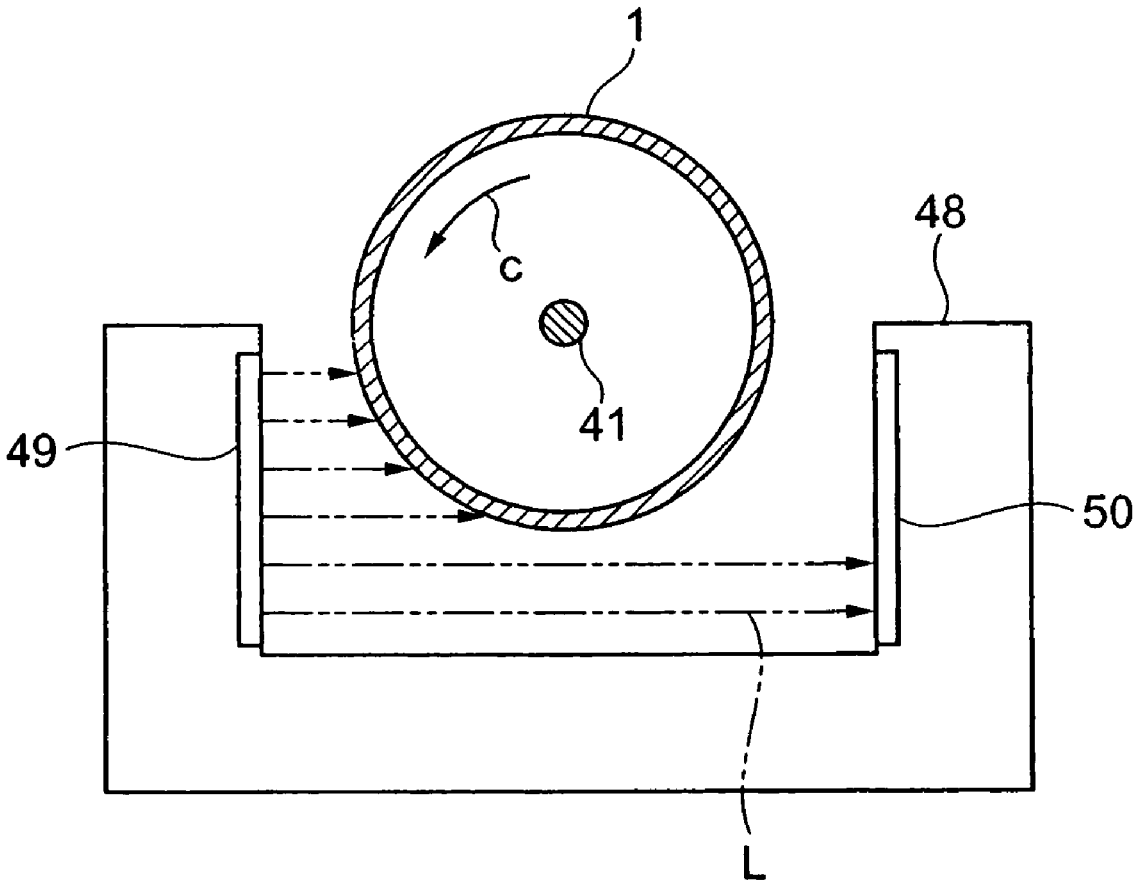
FIG. 7 is a partly-enlarged cross-sectional view showing the positional relationship between a laser sensor and a photoreceptor drum.

In case where the direction of eccentricity of the photoreceptor drum 1 is measured by the use of the inspection device 310 having the configuration as illustrated, the photoreceptor drum 1 is rotated in the direction of the arrow C in FIG. 7 by the drum rotation-driving member 45 via the gear part of the flange 3. Parallel light L is radiated from the laser radiating part 49, and the parallel light L not cut off by the photoreceptor drum 1 reaches the laser-receiving part 50 and is receive by it. Based on the position at which the laser-receiving part 50 has detected the parallel light L not cut off by the photoreceptor drum 1, the distance between the center of the photoreceptor drum 1 and the outer surface thereof may be obtained. Accordingly, this operation is carried out while the photoreceptor drum 1 is rotated and while the laser sensor 48 is moved in the horizontal direction in FIG. 6 along with moving guide 47, whereby the direction of eccentricity of the entire peripheral surface of the photoreceptor drum 1 can be determined. The flange 3 has the position guide 43 fitted thereto. Therefore, for example, based on the position of the position guide 43 as a reference position, the direction of eccentricity of the photoreceptor drum 1 may be determined from the reference position. Even though the position guide 42 is not disposed in the device, the reference position may be set, for example, from the position at which the IC tag is fitted and the position at which the photoreceptor drum and the flange are engaged, and the direction of eccentricity of the photoreceptor drum may be determined relative to the reference position.

Figure 8:
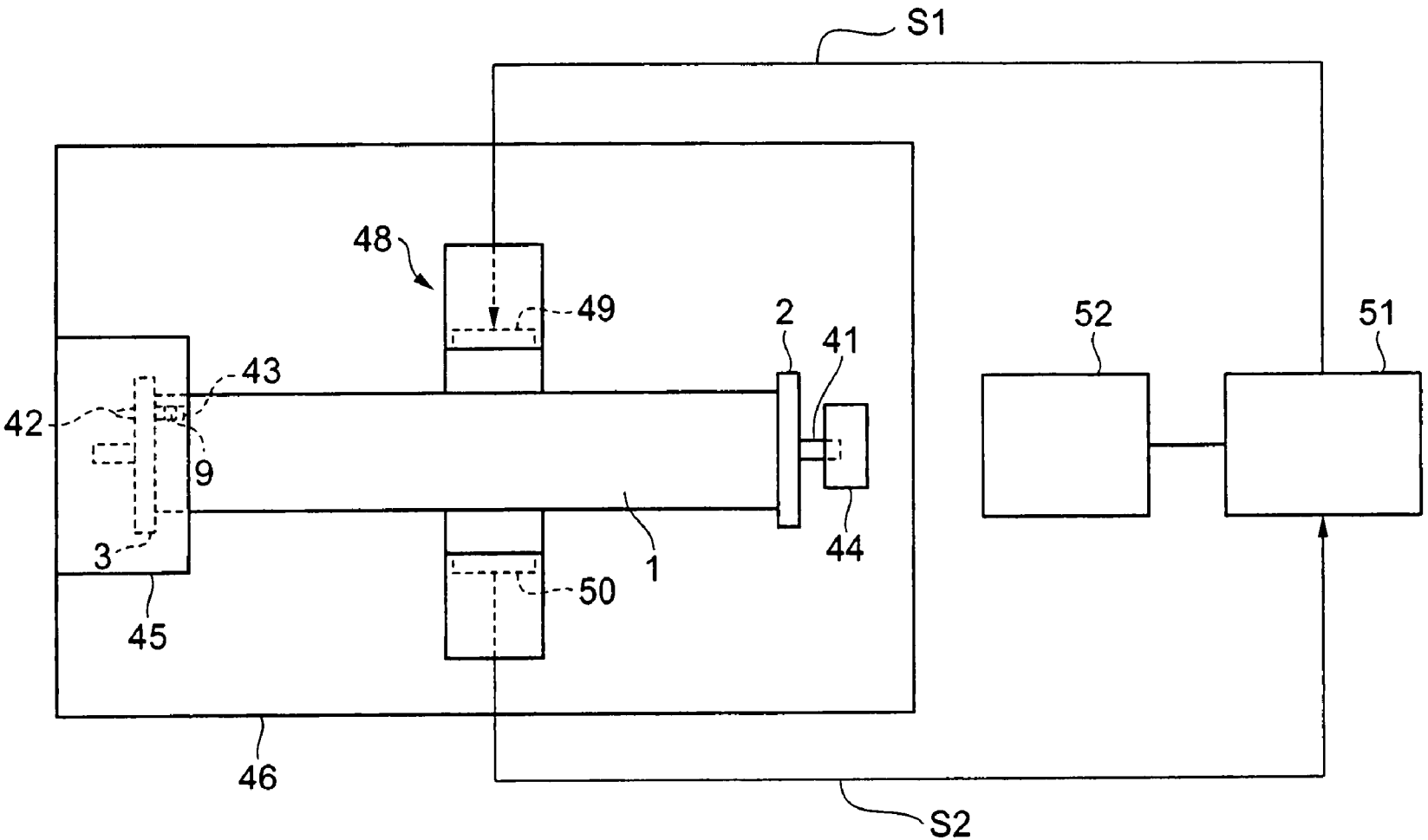
FIG. 8 is an explanatory view for explaining the configuration of the main part of an direction of eccentricity inspection device.

FIG. 8 is an explanatory view for explaining the configuration of the main part of the inspection device 310. As shown in FIG. 8, a computer 51 is electrically connected to the laser-radiating part 49 and the laser-receiving part 50 for controlling these parts. In the process of measurement, a scanning exposure control signal S1 is transferred from the computer 51 to the laser-radiating part 49, and a reading signal S2 is transferred from the laser-receiving part 50 to the computer 51. The measured information data thus transferred to the computer 51 are processed therein, and then transferred from the transmitter 52 to the IC tag 9 as the information about the direction of eccentricity, and recorded on the IC tag 9.

By the inspection devices 300 and 310 mentioned above, the inspection information relating to the photoreceptor drum 1 is measured and written on the IC tag 9. In addition to those mentioned above, any other information data of the photoreceptor drum 1, for example, the type, the lot, the production date, the machine code, the product number and the use history thereof may be written on the IC tag 8. When the electrophotographic photoreceptor 100 of the invention thus having the IC tag with such inspection information written thereon is mounted on an image forming apparatus equipped with a control unit capable of reading the inspection information written on the IC tag 9 and controlling the image-forming condition on the basis of the inspection information, as mentioned below, then the image forming apparatus can stably form images of good quality even though the quality of the photoreceptor 100 fluctuates in point of the sensitivity, the charging characteristic and the direction of eccentricity thereof or even though the properties of the photoreceptor 100 change owing to the design change thereof.

Image Forming Apparatus

Figure 9:
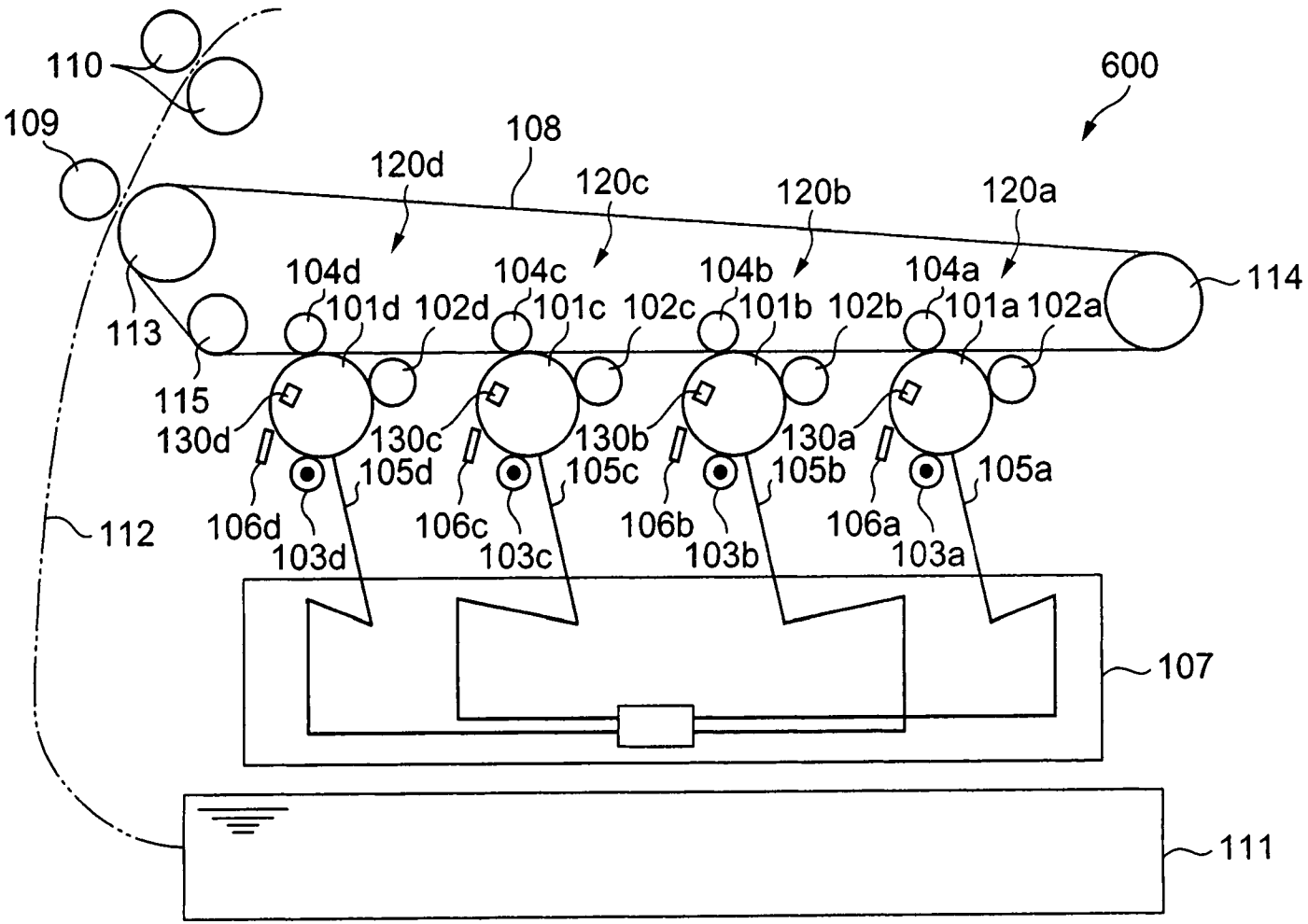
FIG. 9 is a schematic configurational view showing one embodiment of the image forming apparatus.

FIG. 9 is a schematic configurational view showing one preferred embodiment of the image forming apparatus of the invention. The image forming apparatus 600 shown in FIG. 9 is a tandem-type intermediate transfer system image forming apparatus. The image forming apparatus 600 shown in FIG. 9 can be used for duplicators, laser beam printers, etc. The image forming apparatus 600 includes four image-forming units 120*a*, 120*b*, 120*c* and 120*d*. The four image-forming units 120*a* to 120*d* are disposed in parallel to each other along a part of an intermediate transfer medium 108.

The image-forming units 120*a* to 120*d* are equipped with drum-type electrophotographic photoreceptors 101*a* to 101*d*, respectively, and the electrophotographic photoreceptors 101*a* to 101*d* are rotatable in a predetermined direction (in a counterclockwise direction on the drawing) at a predetermined peripheral speed (process speed). The electrophotographic photoreceptors 101*a* to 101*d* are the above-mentioned electrophotographic photoreceptors of the invention. Specifically, the electrophotographic photoreceptors 101*a* to 101*d* are equipped with IC tags (non-contact IC tags) 130*a* to 130*d*, respectively, in which the inspection information of each photoreceptor is accumulated. The position in which the IC tags 130*a* to 130*d* are to be fitted is not specifically defined.

The electrophotographic photoreceptors 101*a* to 101*d* are equipped with contact charge-type charging units 103*a* to 103*d*, developing units 102*a* to 103*d*, primary transfer units 104*a* to 104*d*, and cleaning units 106*a* to 106*a*, respectively, in order in the rotary direction thereof. To the developing units 102*a* to 102*d*, four color toners of yellow (Y), magenta (M), cyan (C) and black (K) stored in toner cartridges (not shown) can be fed, and not only black-and-white images but also color images may be formed. The primary transfer units 104*a* to 104*d* are kept in contact with the electrophotographic photoreceptors 101*a* to 101*d*, respectively, via the intermediate transfer medium 108 therebetween.

In FIG. 9, the developing units 102*a* to 102*d* are disposed in the order of the toner colors of Y, M, C and K. The toner color arrangement may be determined in any desired manner in accordance with the image-forming method of the system employed, for example in an order of M, Y, C and K.

At a predetermined position of the image forming apparatus 600, disposed is an exposing unit 107 (ROS: Raster Output Scanner). The exposing unit 107 has an optical system for original image color separation and exposure to light for image formation, and a scanning and exposing system with a laser scanner that outputs laser beams modulated in accordance with the time-series electric digital pixel signal of image information. The laser beams outputted from the exposing unit 107 are branched into laser beams 105*a* to 105*d*, and are radiated to the surface of the charged electrophotographic photoreceptors 101*a* to 101*d* of the image-forming units 120*a* to 120*d*, respectively. Accordingly, while the electrophotographic photoreceptors 101*a* to 101*d* are rotated, they are subjected to the steps of charging, exposure, development, primary transfer and cleaning in that order, whereby toner images of different colors are, overlapping on one after another, transferred on the intermediate transfer medium 108.

The intermediate transfer medium 108 is in the form of an endless belt, and is supported by a driving roll 114, a backup roll 113 and a tension roll 115 under predetermined tension, and this is rotatable at the same peripheral speed as that of the electrophotographic photoreceptors 101*a* to 101*d* not loosening due to the rotation of these rolls. A part of the intermediate transfer medium 108 that is positioned in the intermediate between the driving roll 114 and the backup roll 113 is kept in contact with the electrophotographic photoreceptors 101*a* to 101*d*.

A secondary transfer unit 109 is positioned so as to be in contact with the intermediate transfer medium 108 via the backup roll therebetween. The intermediate transfer unit 108 having passed between the backup roll 113 and the secondary transfer unit 109 is, after cleaned on its surface with a cleaning blade (not shown), for example, disposed near to the driving roll 114, led to the next image-forming process.

A tray 111 is disposed at a predetermined position inside the image forming apparatus 600. Sheets of copying paper are in the tray 111, serving as a transfer medium 112. The transfer medium 112 in the tray 111 is transported to pass between the secondary transfer unit 109 and the backup roll 113 by the action of a transportation unit (not shown). The transfer medium 112 is further transferred to pass between two fixation rolls 110 kept in contact with each other, and then taken out of the image forming apparatus 600.

At a predetermined position inside the image forming apparatus 600, disposed in a control unit (not shown) that reads the inspection information data of the electrophotographic photoreceptors 101*a* to 101*d* from their IC tags 130*a* to 130*d*, respectively, and controls the image-forming condition on the basis of the inspection information. At the start of the image forming apparatus 600, or during the inspection thereof or during the exchange of the photoreceptor, the control unit acts to read the inspection information of each photoreceptor.

The charging units 103*a* to 103*d* are not specifically defined, and may be any per-se known charger, for example, a contact-type charger that includes a conductive or semiconductive charge roll, charge brush, charge film, charge rubber blade or charge tube; a non-contact roll charger of using a charge roll in the vicinity of the photoreceptor; or a scorotron charger or a corotron charger of utilizing corona discharge. Of those, contact-type chargers are much used as having good charge compensation capability.

The contact-type charging system is for charging the surface of the photoreceptor by applying a voltage to the conductive member that is kept in contact with the surface of the photoreceptor. Regarding its shape, the conductive member may be any of brushes, blades, pin-like electrodes or rolls, but roll members are preferred. In general, the roll member includes a resistant layer, an elastic layer to support it and a core that are disposed in that order from the outer side thereof. If desired, a protective layer may be provided outside on the resistant layer.

When kept in contact with the photoreceptor, the roll member may rotate at the same peripheral speed as that of the photoreceptor, even though it does not have any specific driving unit, and may therefore function as a charging unit. However, some driving unit may be fitted to the roll member so as to rotate the member at a peripheral speed different from that of the photoreceptor, and the photoreceptor may be thus charged by the roll member.

The material of the core is conductive, and is generally iron, copper, brass, stainless, aluminium or nickel. In addition, also usable are molded resin articles with conductive particles dispersed therein. The material of the elastic layer is conductive or semiconductive, and is generally a rubber material with conductive particles or semiconductive particles dispersed therein. For the rubber material, usable are EPDM, polybutadiene, natural rubber, polyisobutylene, SBR, CR, NBR, silicone rubber, urethane rubber, epichlorohydrin rubber, SBS, thermoplastic elastomer, norbornen rubber, fluorosilicone rubber, ethylene oxide rubber. For the conductive particles or the semiconductive particles, usable are carbon black, metals such as zinc, aluminium copper, iron, nickel, chromium, titanium; and metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, MgO. One or more of these materials may be used herein either singly or as combined.

For the material of the resistant layer and the protective layer, conductive particles or semiconductive particles may be dispersed in a binder resin with controlling the resistance of the resulting dispersion. The specific resistance of the layer may be from $10^3$ to $10^{14}$ Ω·cm, preferably from $10^5$ to $10^{12}$ Ω·cm, more preferably from $10^7$ to $10^{12}$ Ω·cm. The thickness of the layer may be from 0.01 to 1000 μm, preferably from 0.1 to 500 μm, more preferably from 0.5 to 100 μm. The binder resin includes acrylic resin, cellulose resin, polyamide resin, methoxyethylated nylon, ethoxymethylated nylon, polyurethane resin, polycarbonate resin, polyester resin, polyethylene resin, polyvinyl resin, polyarylate resin, polythiophene resin, polyolefin resin such as PFA, FEP, PET, and styrene-butadiene resin. For the conductive particles or the semiconductive particles, usable are carbon black, metals and metal oxides that may be the same as those for the elastic layer. If desired, an antioxidant such as hindered phenol or hindered amine, a filler such as clay or kaolin, and a lubricant such as silicone oil may be added to the layers.

For forming the layers, employable are methods of blade coating, Mayer bar coating, spraying, dipping, bead coating, air knife coating or curtain coating.

For charging the photoreceptor by the use of the conductive member, a voltage may be applied to the conductive member, for which a method is preferred including applying a direct current voltage thereto or applying thereto a direct current voltage and an alternating current voltage in superimposition. Regarding the range thereof, the direct current voltage is preferably from negative or positive 50 to 2000 V, more preferably from 100 to 1500 V in accordance with the charge potential of the photoreceptor. When an alternating current voltage is superimposed, then its peak-to-peak voltage is preferably from 400 to 1800 V, more preferably from 800 to 1600 V, even more preferably from 1200 to 1600 V. The frequency of the alternative voltage may be from 50 to 20,000 Hz, preferably from 100 to 5,000 Hz.

The exposing unit 107 is not specifically defined, for which, for example, usable is an optical instrument capable of imagewise exposing the surface of the electrophotographic photoreceptors 101*a* to 101*d* in any desired manner to the light from a light source of semiconductor laser light, LED light, liquid-crystal shutter light or the like. The wavelength of the light from the light source shall fall within the spectral sensitivity range of the photoreceptor. Heretofore, near IR rays having an oscillation wavelength at around 780 nm is mainly used as the semiconductor laser for the exposure, but lasers having an oscillation wavelength of around 600 s nm as well as blue lasers having an oscillation wavelength at around 400 to 500 nm may also be used. For color image formation, surface-emitting laser sources that enable multi-beam emission are effective.

The developing units 102*a* to 102*d* have the function of developing the electrostatic latent images formed on the electrophotographic photoreceptors 101*a* to 101*d* to form toner images. The developing step is for developing the electrostatic latent images formed on the electrophotographic photoreceptors 101*a* to 101*d* to form toner images. For example, the development may be effected in any ordinary contact or non-contact mode with a magnetic or non-magnetic one-pack or two-pack developer. Accordingly, the developing units 102*a* to 102*d* are not specifically defined so far as they have the above-mentioned function and may be suitably selected in accordance with their object. For example, they may be known developing units having the function of applying a one-pack or two-pack developer to the electrophotographic photoreceptors 101*a* to 101*d* by the use of a brush or a roll.

The primary transfer units 104*a* to 104*d* have the function of transferring the toner images formed on the electrophotographic photoreceptors 101*a* to 101*d* to the intermediate transfer medium in a mode of reversal development. The primary transferring step is for transferring the toner images formed on the electrophotographic photoreceptors 101*a* to 101*d* to the intermediate transfer medium in a mode of reversal development. The primary transferring step is favorably attained by the use of the primary transfer units 104*a* to 104*d*. In the following description, transferring the toner images onto the intermediate transfer medium may be referred to as "primary transferring". This step is optionally carried out, and as the case may be, it may be omitted, and the images may be directly transferred from the photoreceptors onto a transfer medium such as paper.

The primary transfer units 104*a* to 104*d* are not specifically defined so far as they have the above-mentioned function, for which any per-se known transfer chargers may be used including, for example, a contact-type transfer charger that uses a belt, a roller, a film or a rubber blade, and a scorotron transfer charger or a corotron transfer charger that utilizes corona discharge. Of those, preferred is a contact-type transfer charger as having excellent transfer charge compensation capability. In the invention, a peel charger may also be used in addition to the transfer charger. During the primary transfer operation, a direct current is generally used as the transfer current to be applied to the electrophotographic photoreceptors 101*a* to 101*d* from the primary transfer units 104*a* to 104*d*, but an alternating current may also be used as superimposed thereon. The condition to be set for the primary transfer units 104*a* to 104*d* could not be indiscriminately defined, as varying depending on the image region width to be charged, the shape and the opening width of the transfer charger used and the process speed (peripheral speed) of the units. For example, the primary transfer current to be set may be from +100 to +400 μA, and the primary transfer voltage to be set may be from +500 to +2000 V.

Regarding its structure, the intermediate transfer medium 108 may have a single-layered structure or a multi-layered structure. For example, the multi-layered structure may comprise an elastic layer of rubber, elastomer or resin and at least one coating layer formed on a conductive supporting member. The shape of the intermediate transfer medium 108 is not specifically defined and may be suitably selected in accordance with the object thereof, for which, for example, preferred are rollers and belts. Of those, in the invention, especially preferred is an endless belt in view of its advantages of good superposition in color image formation, good durability in repeated use and broad latitude in disposition of other subsystems. The intermediate transfer medium 108 having such an endless belt form may be fabricated by centrifugal molding, spray coating or dipping film formation. In addition, a conductive film sheet may be seamed into a belt.

The material of the intermediate transfer medium 108 may be any known conductive thermoplastic resin, including, for example, conductive agent-containing polyimide resin, polycarbonate resin (PC), polyvinylidene fluoride (PVDF), polyalkylene terephthalate (PAT), ethylene-tetrafluoroethylene copolymer (ETFE), as well as blend materials such as ETFE/PC, ETFE/PAT, PC/PAT. Of those, preferred is conductive agent-dispersed polyimide resin as having good mechanical strength.

As the conductive agent, usable are carbon black, metal powder, metal oxide such as tin oxide, indium oxide, black titanate, and conductive polymer such as polyaniline. Of those, preferred is polyimide resin with carbon particles dispersed therein.

A polyimide resin belt with a conductive agent dispersed therein may be fabricated by dispersing from 5 to 20% by weight of carbon black, as a conductive agent, into a solution of a polyimide precursor, polyamidic acid, casting the resulting dispersion onto a metal drum and drying it, and then stretching the film peeled from the drum, at a high temperature to form a polyimide film, and cutting it into an endless belt having a suitable size. In general, the film formation may be carried out, for example, as follows: A film-forming stock of a polyamidic acid solution with a conductive material dispersed therein is put into a drum mold, and, while the drum mold is heated at 100 to 200° C. and rotated at 500 to 2000 rpm, this is formed into a film according to a centrifugal molding method, and then the resulting film is removed from the mold while it is in a semi-cured condition, and fitted to an iron core, and this is essentially cured by heating it at a high temperature not lower than 300° C. for polyimidation (ring closure reaction of polyamidic acid). Apart from it, another method may also be employed which includes casting the film-forming stock onto a metal sheet to form a layer thereon having a uniform thickness, then heating it at 100 to 200° C. in the same manner as in the above to thereby remove a major part of the solvent, and stepwise heating it up to a higher temperature not lower than 300° C. to form the intended polyimide film. The intermediate transfer medium may have a surface layer.

The surface volume resistivity value of the intermediate transfer medium 108 is, for example, preferably from $10^8$ to $10^{16}$ Ω·cm. If the surface volume resistivity value is smaller than $10^8$ Ω·cm, then the images formed may be blurred or thickened; but if larger than $10^{16}$ Ω·cm, then the images may scatter or the intermediate transfer medium sheet must be discharged. Anyhow, both of these are unfavorable. When the intermediate transfer medium is in the form of a belt, in general, its thickness if preferably from 50 to 500 μm, more preferably from 60 to 150 μm, and it may be suitably determined depending on the hardness of the material thereof.

The secondary transfer unit 109 has the function of transferring the toner images on the intermediate transfer medium 108, all at a time onto a transfer material such as paper, or, when the intermediate transfer medium 108 is not used, the unit has the function of transferring the toner images on the drum, successively onto such a transfer material. The secondary transfer step may be favorably effected by the use of the secondary transfer unit 109. In the following description, transferring the toner images onto the transfer material may be referred to as "secondary transferring".

So far as it has the above-mentioned function, the secondary transfer unit 109 is not specifically defined, for which, for example, employable is a contact-type transfer charger, a scorotron transfer charger and a corotron transfer charger such as those mentioned hereinabove for the primary transfer units 104*a* to 104*d*. Of those, preferred is a contact-type transfer charger like that for the primary transfer units 104*a* to 104*d*. For the transfer current to be applied to the intermediate transfer medium 108 from the secondary transfer unit 109 during the secondary transferring operation, herein generally employed is a direct current, but an alternating current may be superimposed thereon in the invention.

The condition to be set for the secondary transfer unit 109 could not be indiscriminately defined, as varying depending on the image region width to be charged, the shape and the opening width of the transfer charger used and the process speed (peripheral speed) of the unit. For example, the secondary transfer current to be set may be from +100 to +400 μA, and the secondary transfer voltage to be set may be from +2000 to +5000 V.

The image forming apparatus 600 may further comprise a photodischarging unit for photodischarging the electrophotographic photoreceptors 101*a* to 101*d*, and a fixing unit for fixing the toner image secondary-transferred on the transfer material.

The photodischarging unit includes, for example, a tungsten lamp and LED, and the quality of light for the photodischarging may be, for example, white light from a tungsten lamp and red light from LED. The light intensity set for the photodischarging may be from around a few times to 30 times as large as the quantity of light that indicates the half-value exposure sensitivity of the electrophotographic photoreceptors 101*a* to 101*d*.

The fixing unit is not specifically defined and may be any per-se known one, for example, including a thermal roll fixing unit and an oven fixing unit.

A method for image formation by the use of the above-mentioned image forming apparatus 600 is described below.

In the image forming apparatus 600, when the electrophotographic photoreceptors 101*a* to 101*d* are rotated and driven, then the charging units 103*a* to 103*d* are thereby driven as connected with them. Accordingly, the surfaces of the electrophotographic photoreceptors 101*a* to 101*d* are uniformly charged at a predetermined potential of a predetermined polarity (charging step) Next, the electrophotographic photoreceptors 101*a* to 101*d* of which the surfaces have been thus uniformly charged are imagewise exposed to the laser light 105*a* to 105*d* emitted by the exposing unit 107, and an electrostatic latent image is thus formed on the surfaces of the electrophotographic photoreceptors 101*a* to 101*d* (exposure step).

The electrostatic latent image is developed with the toner in the developing units (monochromatic developing units for reversal development) 102*a* to 102*d*, and toner images are formed on the surfaces of the electrophotographic photoreceptors 101*a* to 101*d* (development step). In this step, the toner may be any of a two-component toner or a one-component toner.

While passing through the interface (nip space) between the photoreceptors 101*a* to 101*d* and the intermediate transfer medium 108, the toner images are successively transferred (intermediate-transferred) onto the peripheral surface of the intermediate transfer medium 108 owing to the electric field formed by the primary transfer bias applied to the intermediate transfer medium 108 from the primary transfer devices 104*a* to 104*d* (intermediate (primary) transfer step). The primary transfer bias applied to the intermediate transfer medium 108 from the photoreceptors 101*a* to 101*d* has a polarity (+) opposite to that of the toner and this is applied from a bias power source. The bias voltage is, for example, from +2 kV to +5 kV.

In that manner, toner images of different colors are transferred from the image-forming units 120*a* to 120*d* onto the intermediate transfer medium 108, as superimposed thereon, to give a color toner image. The color toner image is then transferred from the intermediate transfer medium 108 onto a transfer medium 112 owing to the contact charging action of the secondary transfer unit 109 (secondary transfer step); and this is fixed on the transfer medium 112 by the fixing rolls 110 to give a color image thereon.

The toner remaining on the electrophotographic photoreceptors 101*a* to 101*d* are cleaned and removed by the cleaning units 106*a* to 106*d*. Accordingly, the electrophotographic photoreceptors 101*a* to 101*d* are then applied to the next copying cycle.

In the image forming apparatus 600 of the invention, the image-forming condition for image formation as mentioned above is controlled by the above-mentioned control unit on the basis of the inspection information read from the IC tags 130*a* to 130*d* fitted to the electrophotographic photoreceptors 101*a* to 101*d*, respectively.

Concretely, when the inspection information includes the information about the direction of eccentricity of the electrophotographic photoreceptors 101*a* to 101*d*, then the registration is so attained that the direction of eccentricity of the electrophotographic photoreceptors 101*a* to 101*d* could be unified at the same image formation position with a dislocation angle of 10 degrees. Specifically, based on the information about the direction of eccentricity of each photoreceptor, the angle at which the respective photoreceptors should be shifted so as to unify the eccentric maximum direction of the photoreceptors at the same image formation position is computed through the information control, and the respective photoreceptors, for example, some of the four are rotated while the image forming apparatus 600 is warmed up. The photoreceptors are so designed that the their drums can be independently rotated and driven by freely controlling the on-off condition of the respective clutches. Therefore, according to a method of putting on the clutch of only the photoreceptor to be changed for its phase so as to rotate the photoreceptor drum to thereby unify its phase with those of the other drums; or according to a method of putting off the clutch of only the photoreceptor to be changed for its phase so as to stop the rotation of only the photoreceptor drum, while the other three drums are kept rotated, and stopping all the drums at the position at which they are correctly registered whereby the on-off condition of the clutches of all the photoreceptors is unified, the intended registration of the photoreceptors can be attained. Attaining the registration makes it possible to stably form images of good quality with sufficiently reduced color unevenness. From the viewpoint of more sufficiently reducing the occurrence of color unevenness, it is desirable that the dislocation angle at the same image-forming position of the direction of eccentricity of the electrophotographic photoreceptors 101*a* to 101*d* is at most 10 degrees, and is preferably nearer to 0°. The registration can be automatically attained by the control unit, and, for example, when at least one of the electrophotographic photoreceptors 101*a* to 101*d* is exchanged for new one, then the relationship of the direction of eccentricity of the photoreceptors can be automatically optimized by the control unit even though the exchange is carried out in an ordinary manner with no specific attention to the direction of eccentricity of the new photoreceptor since the new photoreceptor is equipped with the IC tag.

The eccentricity of a drum photoreceptor is generally from 10 to 100 μm or so. Therefore, the change in the scanning direction of the image-forming position, $\Delta x$ is represented by $\Delta x=\Delta r/\tan\theta$ in which $\theta$ indicates the angle between the photoreceptor and the laser light applied thereto, and $\Delta r$ indicates the change of the photoreceptor in the depth direction thereof. Accordingly, the change is the largest at the end of the photoreceptor, and the image unevenness owing to the photoreceptor eccentricity is remarkable at the end of the photoreceptor. By unifying the direction of eccentricity of the photoreceptors, the image position fluctuation between different colors can be minimized. In general, the degree of eccentricity of the substrate of the photoreceptor can be reduced by lathing the substrate.

When the inspection information includes the information about the I-V characteristic of the electrophotographic photoreceptors 101*a* to 101*d*, then the voltage to be applied to the electrophotographic photoreceptors 101*a* to 101*d* from the charging units 103*a* to 103*d* may be controlled on the basis of the information about the I-V characteristic.

When the inspection information includes the information about the sensitivity of the electrophotographic photoreceptors 101*a* to 101*d*, then the power of output from the exposing unit 107 is controlled on the basis of the sensitivity information and the quantity of light to which the electrophotographic photoreceptors 101*a* to 101*d* are exposed is thereby controlled. For example, when the sensitivity of the electrophotographic photoreceptors 101*a* to 101*d* is low, then the power of output from the exposing unit 107 is so controlled as to increase the quantity of light for exposure.

Figure 10:
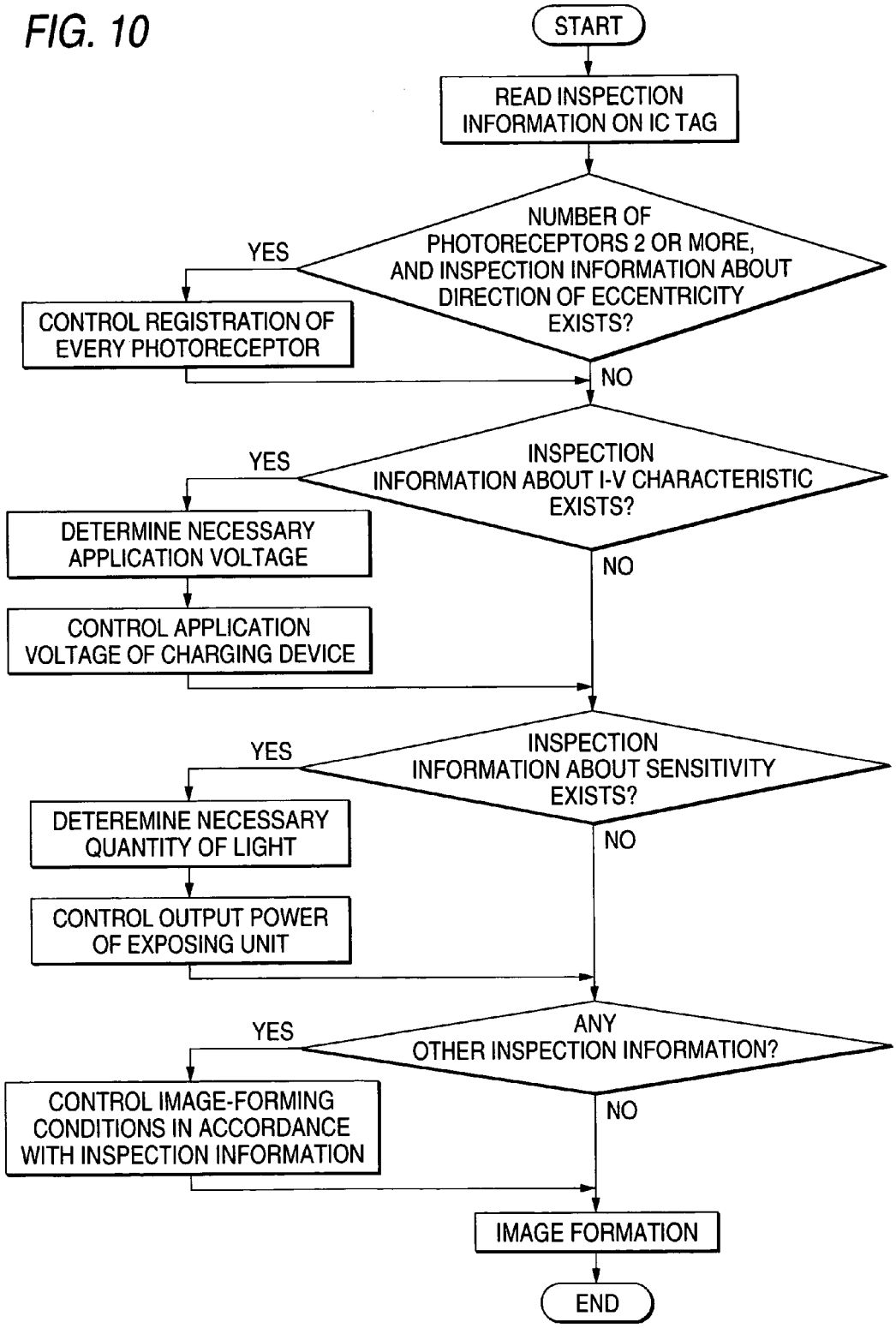
FIG. 10 is a flowchart showing a process of reading the inspection information from an IC tag and controlling image-forming conditions.

When the inspection information includes the information about any other matter than the above of the electrophotographic photoreceptors 101*a* to 101*d*, then the image-forming conditions including the charging condition, the exposure condition and the development condition are controlled according to the inspection information. FIG. 10 shows a flowchart indicating the process of reading the inspection information from an IC tag and controlling the image-forming conditions.

For controlling the image-forming conditions including the voltage application by the charging units 103*a* to 103*d* and the output power of the exposing unit 107, for example, controlled image-forming conditions are previously inputted into a control unit and the image-forming conditions may be controlled according to the controlled conditions.

As mentioned above, the image-forming conditions in image formation may be controlled on the basis of the inspection information read from the non-contact IC tag, and therefore images of good quality can be stably obtained even though the photoreceptors fluctuate in point of their quality including the sensitivity, the charging characteristic and the direction of eccentricity thereof or even though the properties of the photoreceptors change owing to the design change thereof.

The image forming apparatus 600 may also has a non-contact IC tag with some inspection information written thereon, relating to any other structural members than the electrophotographic photoreceptors 101*a* to 101*d*, such as the inspection information about the developer to be used in the developing units 102*a* to 102*d*, the inspection information about the intermediate transfer medium 108 and the inspection information about the cleaning units 106*a* to 106*d*.

The inspection information about the developer includes the particle size, the particle size distribution, the tribological characteristic, the spherical coefficient and the charge distribution thereof. The inspection information about the intermediate transfer medium includes the volume resistivity, the surface resistivity, the surface roughness and the surface hardness thereof. The inspection information about the cleaning units includes the elasticity, the layer thickness and the hardness thereof. Needless-to-say, the IC tag may include any other inspection information than the above.

The non-contact IC tag with the inspection information about the developer written thereon may be fitted, for example, to the surface or inside the exchange developer cartridges. The non-contact IC tag with the inspection information about the intermediate transfer medium written thereon may be fitted, for example, to the intermediate transfer medium cartridge or inside the intermediate transfer medium. The non-contact IC tag with the inspection information about the cleaning units written thereon may be fitted, for example, to the metal part of the respective cleaning blades or to the surface part thereof. Needless-to-say, the non-contact IC tag may be fitted to any other site than the above so far as it may not be a bar to image information.

The inspection information data written on the non-contact IC tag are read by the above-mentioned control unit, and the image-forming conditions are thereby controlled in accordance with the respective inspection information data. For example, the charging characteristic of the photoreceptor is read, and the voltage application condition of the charger to the photoreceptor can be thereby controlled. The sensitivity condition of the photoreceptor is read, and the condition for exposure to light of the photoreceptor may be controlled based on the result to thereby obtain images of more stable quality.

Figure 11:
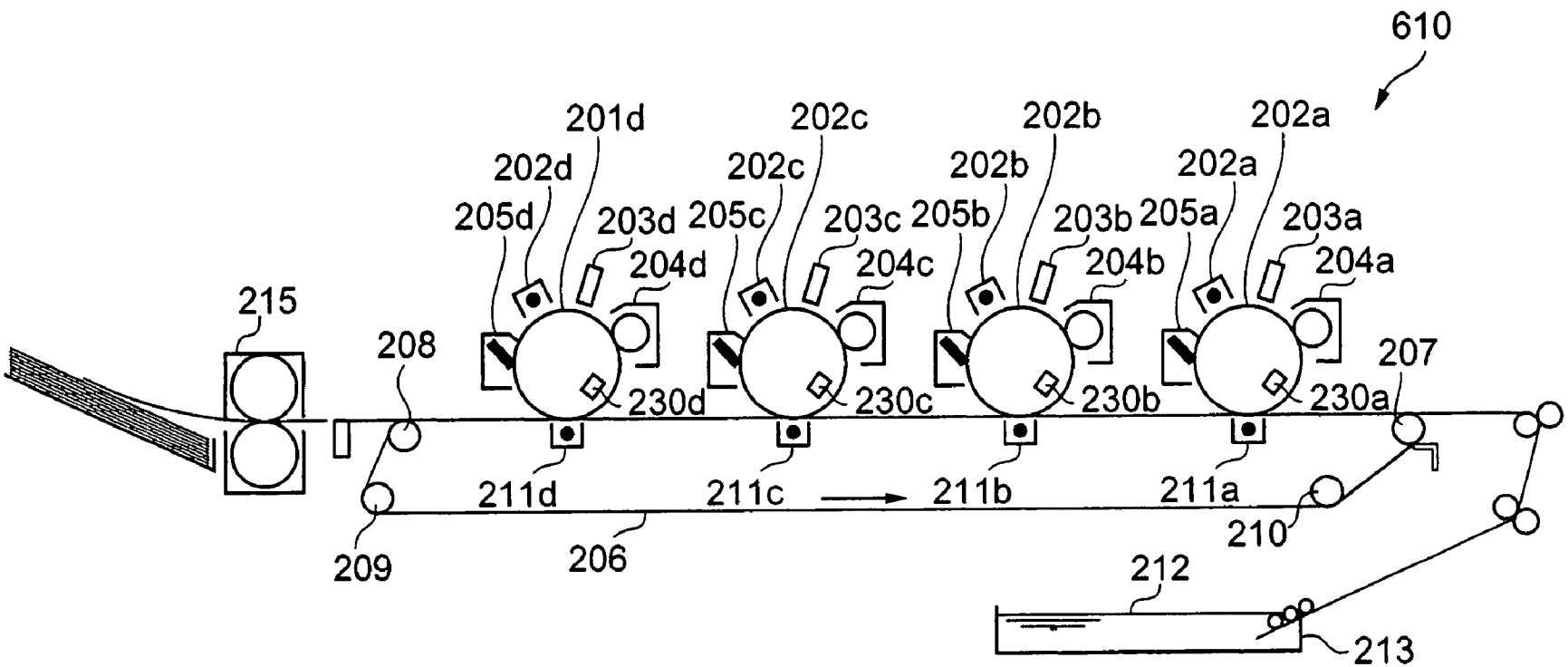
FIG. 11 is a schematic configurational view showing another embodiment of the image forming apparatus of the invention.

FIG. 11 is a schematic configurational view showing another preferred embodiment of the image forming apparatus of the invention. Not having an intermediate transfer medium therein, the image forming apparatus 610 shown in FIG. 11 includes four drum-type electrophotographic photoreceptors 201*a* to 201*d* disposed in parallel to each other along a paper conveyor belt 206, like the image forming apparatus shown in FIG. 9. The electrophotographic photoreceptors 201*a* to 201*d* are, for example, as follows: The electrophotographic photoreceptor 201*a* may form a yellow image; the electrophotographic photoreceptor 201*b* may form a magenta image; the electrophotographic photoreceptor 201*c* may form a cyan image; an the electrophotographic photoreceptor 201*d* may form a black image. Specifically, the electrophotographic photoreceptors 201*a* to 201*d* have IC tags (non-contact IC tags) 230*a* to 230*d*, respectively, fitted thereto, and the inspection information data of the respective photoreceptors are accumulated in the IC tags. The position in which the IC tags 230*a* to 230*d* are fitted is not specifically defined.

The electrophotographic photoreceptors 201*a* to 201*d* are rotatable in a predetermined direction (in a clockwise direction on the drawing) at a predetermined peripheral speed (process speed), and along the rotation direction thereof, disposed are charging units 202*a* to 202*d*, exposing units 203*a* to 203*d*, developing units 204*a* to 204*d*, transfer units 211*a* to 211*d*, and cleaning units 205*a* to 205*d*.

At a predetermined position inside the image forming apparatus 610, disposed is a control unit (not shown) for reading the inspection information of the electrophotographic photoreceptors 201*a* to 201*d* from the respective IC tags 230*a* to 230*d* and for controlling the image-forming conditions on the basis of the inspection information. At the start of the image forming apparatus 610, or at the inspection thereof, or at the exchange of photoreceptors therein, the control unit is driven to read the inspection information of each photoreceptor.

The exposing units 203*a* to 203*d*, the developing units 204*a* to 204*d*, the transfer units 211*a* to 211*d*, and the cleaning units 205*a* to 205*d* for use herein may be any ordinary ones. In the image forming apparatus 610, scorotron charging devices are used for the charging units 202*a* to 202*d*. Four color toners of yellow (Y), magenta (M), cyan (C) and black (B) separately housed in different toner cartridges (not shown) may be fed to the developing units 204*a* to 204*d*. The transfer units 211*a* to 211*d* are kept in contact with the electrophotographic photoreceptors 201*a* to 201*d*, respectively, via the paper conveyor belt.

In FIG. 11, the developing units 204*a* to 204*d* are disposed in the toner color order of Y, M, C and K. However, these may be suitably disposed in any desired order in accordance with the image-forming system method employed, for example, in order of M, Y, C and K.

Accordingly, like that for the image forming apparatus 600 of FIG. 9, an image-forming process of charging, exposure to light, development, transfer and cleaning steps is carried out in that order in the step of rotation of the electrophotographic photoreceptors 201*a* to 201*d*. The image-forming conditions for image formation in the process are controlled on the basis of the inspection information of the electrophotographic photoreceptors 201*a* to 201*d*, as in the flowchart of FIG. 10.

The paper conveyor belt 206 is supported by rolls 207, 208, 209 and 210 under predetermined tension, and owing to the rotation of the rolls, this is rotatable at the same peripheral speed as that of the electrophotographic photoreceptors 201*a* to 201*d* not loosening.

A tray 213 is disposed at a predetermined position inside the image forming apparatus 610, and paper serving as a transfer medium 212 is put in the tray 213. The transfer medium 212 is led to run successively between the electrophotographic photoreceptors 201*a* to 201*d* and the transfer units 211*a* to 211*d* and through the fixing unit 215 in which two rolls rotate while in contact to each other, and then taken out of the image forming apparatus 610. Accordingly, the toner images formed on the electrophotographic photoreceptors 201*a* to 201*d* are successively transferred onto the transfer medium 212 to form thereon an image (black-and-white image, or color image), and the image is then fixed thereon.

In the image forming apparatus 610 having the configuration as above, the inspection information is red from the IC tags 230*a* to 230*d* fitted to the electrophotographic photoreceptors 201*a* to 201*d*, and during image formation therein, the image-forming conditions are controlled on the basis of the inspection information. Therefore, in this, images of good quality can be stably obtained even though the quality of the photoreceptors fluctuates in point of the sensitivity, the charging characteristic and the direction of eccentricity thereof or even though the properties of the photoreceptors change owing to the design change thereof.

Figure 12:
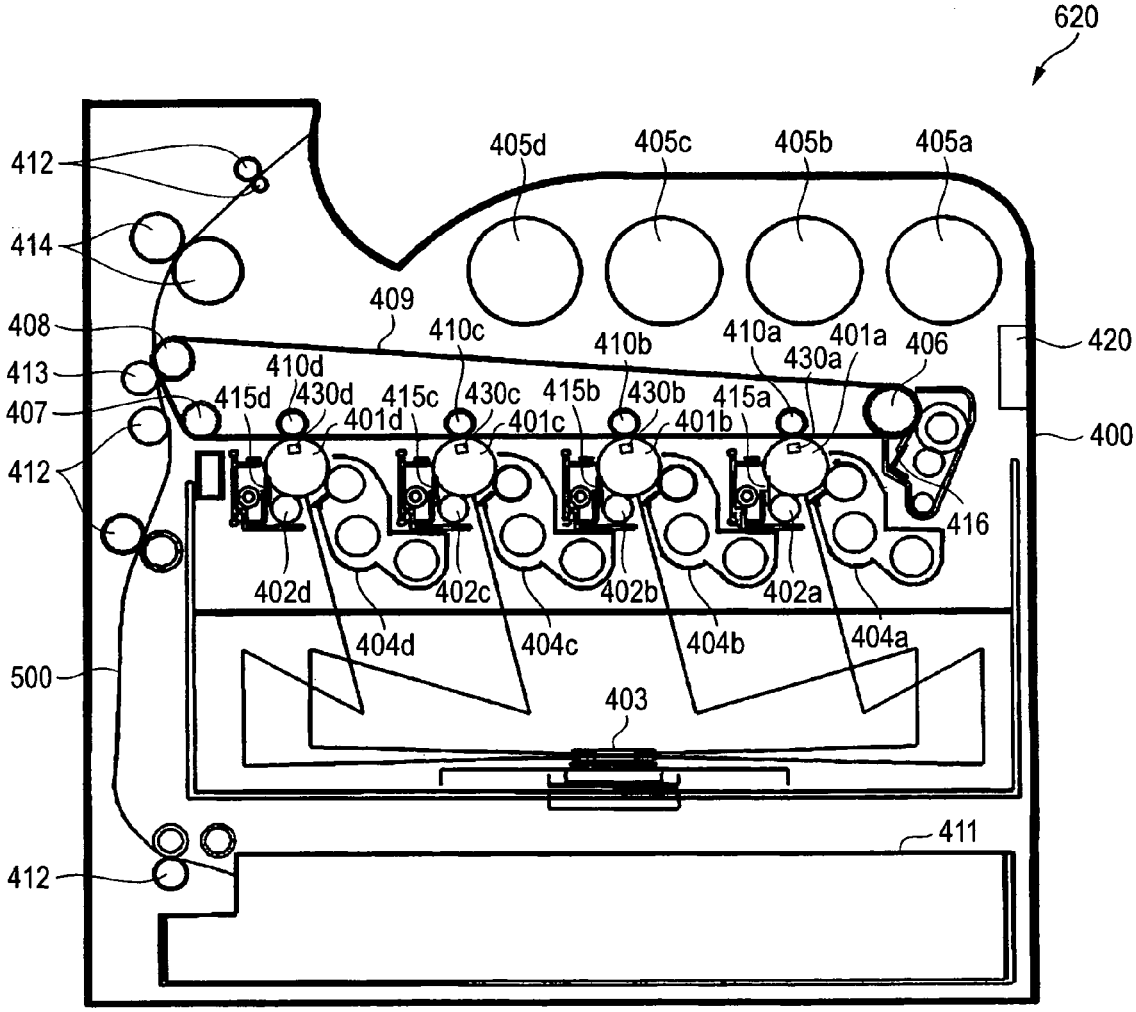
FIG. 12 is a cross-sectional view schematically showing the basic configuration of another embodiment of the image forming apparatus.

FIG. 12 is a cross-sectional view schematically showing the basic configuration of still another preferred embodiment of the image forming apparatus of the invention. The image forming apparatus 620 shown in FIG. 12 is a tandem-system image forming apparatus for color image formation. Inside the housing 400 of the apparatus, disposed are four electrophotographic photoreceptors 401*a* to 401*d* (for example, the electrophotographic photoreceptor 401*a* is for yellow image formation, the electrophotographic photoreceptor 401*b* is for magenta image formation, the electrophotographic photoreceptor 401*c* is for cyan image formation, the electrophotographic photoreceptor 401*d* is for black image formation) in parallel to each other along an intermediate transfer belt 409 therein.

The four electrophotographic photoreceptors 401*a* to 401*d* are the electrophotographic photoreceptors of the invention mentioned above, having IC tags (non-contact IC tags) 430*a* to 430*d*, respectively, fitted to them. In these IC tags, the inspection information of each photoreceptor is accumulated. The position in which the IC tags 430*a* to 430*d* is fitted is not specifically defined.

Inside the housing 400 of the image forming apparatus 620 of the invention, there is disposed a control unit 420 that reads the inspection information of the electrophotographic photoreceptors 401*a* to 401*d* from the respective IC tags 430*a* to 430*d* and controls the image-forming conditions on the basis of the inspection information. At the start of the image forming apparatus 620, or during the inspection thereof or during the exchange of the photoreceptors, the control unit 420 acts to read the inspection information of the photoreceptors.

The electrophotographic photoreceptors 401*a* to 401*d* are rotatable in a predetermined direction (in a counterclockwise direction on the drawing), and along the rotation direction, there are disposed charging rolls 402*a* to 402*d*, developing units 404*a* to 404*d*, primary transfer rolls 410*a* to 410*d*, and cleaning blades 415*a* to 415*d*. Four color toners of black, yellow, magenta and cyan housed in toner cartridges 405*a* to 405*d* may be fed separately to the developing units 404*a* to 404*d*, respectively, and the primary transfer rolls 410*a* to 410*d* are kept in contact with the electrophotographic photoreceptors 401*a* to 401*d*, respectively, via the intermediate transfer belt 409 therebetween.

At a predetermined position inside the housing 400, disposed is a laser light source (exposing unit) 403, and the laser light emitted by the laser light source 403 may be radiated to the surface of the charged electrophotographic photoreceptors 401*a* to 401*d*. Accordingly, an image-forming process of charging, exposure to light, development, primary transfer and cleaning steps is carried out in that order in the step of rotation of the electrophotographic photoreceptors 401*a* to 401*d*, and the toner images formed are transferred onto the intermediate transfer belt 409 as superimposed in order thereon. The image-forming conditions for image formation in the image forming apparatus 620 are controlled on the basis of the inspection information of the electrophotographic photoreceptors 401*a* to 401*d*, as in the flowchart of FIG. 10.

The intermediate transfer belt 409 is supported by a driving roll 406, a backup roll 408 and a tension roll 407 under predetermined tension, and this is rotatable not loosening due to the rotation of these rolls. The secondary transfer roll 413 is disposed to be in contact with the backup roll 408 via the intermediate transfer belt 409 therebetween. The intermediate transfer belt 409 having run between the backup roll 408 and the secondary transfer roll 413 is cleaned on its surface, for example, by the cleaning blade 416 disposed near to the driving roll 406, and then repeatedly used in the next image formation process.

At a predetermined position inside the housing 400, there is disposed a tray (transfer medium tray) 411, and a transfer medium 500 such as paper in the tray 411 is conveyed by a conveyor roll 412 successively between the intermediate transfer belt 409 and the secondary transfer roll 413 and between the two fixing rolls 414 kept in contact to each other.

In the above description, an intermediate transfer belt 409 is used as the intermediate transfer medium. However, the intermediate transfer medium may be in the form of a belt like the intermediate transfer belt 409, or in the form of a drum. When the medium is a belt, then its substrate may be the same as that described hereinabove in the section of the image forming apparatus 600. When the intermediate transfer medium has a configuration of a drum, then its substrate is preferably a cylindrical substrate formed of aluminium, stainless steel (SUS), copper or the like. The cylindrical substrate is optionally coated with an elastic layer, and a surface layer may be formed on the elastic layer.

The transfer medium for use in the invention is not specifically defined so far as it is a medium for transferring thereon the toner image formed on an electrophotographic photoreceptor. For example, when the image is directly transferred from an electrophotographic photoreceptor onto a transfer medium such as paper, then paper is the transfer medium. When an intermediate transfer medium is used, then it is the transfer medium.

In the image forming apparatus 620 having the configuration as above, the inspection information is red from the IC tags 430*a* to 430*d* fitted to the electrophotographic photoreceptors 401*a* to 401*d*, and during image formation therein, the image-forming conditions are controlled on the basis of the inspection information. Therefore, in this, images of good quality can be stably obtained even though the quality of the photoreceptors fluctuates in point of the sensitivity, the charging characteristic and the direction of eccentricity thereof or even though the properties of the photoreceptors change owing to the design change thereof.

Process Cartridge

Figure 13:
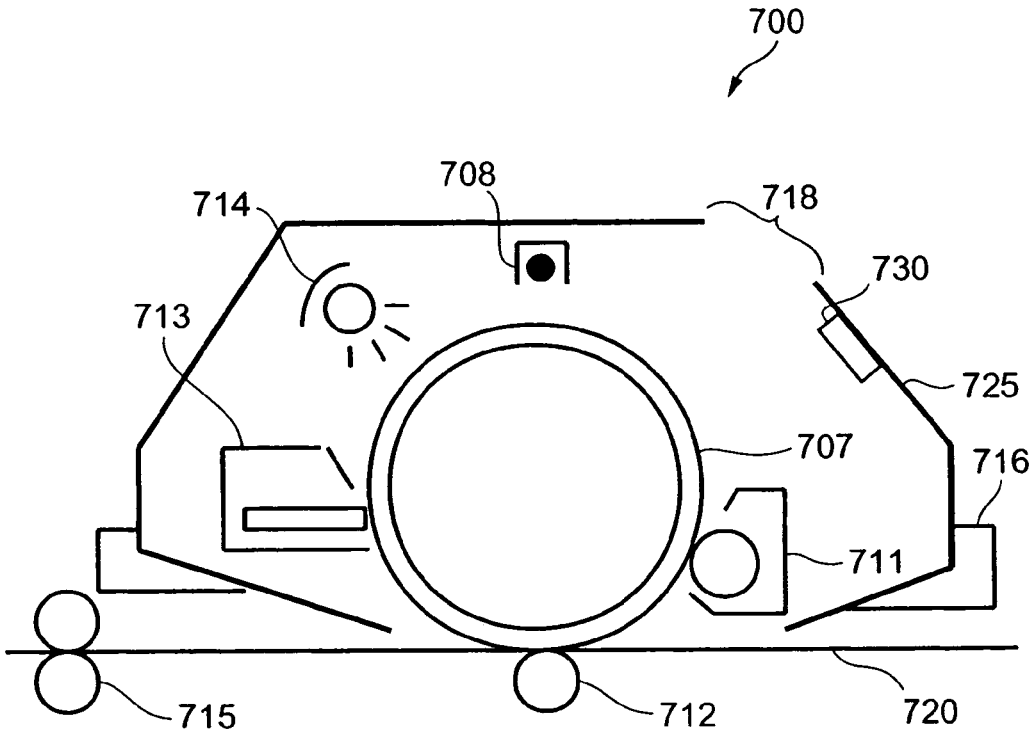
FIG. 13 is a cross-sectional view schematically showing the basic configuration of an embodiment of the process cartridge.

FIG. 13 is a cross-sectional view schematically showing the basic configuration of a preferred embodiment of the process cartridge of the invention. The process cartridge 700 includes an electrophotographic photoreceptor 707 as combined with a charging unit 708, a developing unit 711, a cleaning unit 713, an opening slit 718 for exposure to light and a discharger 714, in which these are integrated by a fitting rail 716. The process cartridge 700 is detachably fitted to an image forming apparatus body that includes a transfer unit 712, a fixing unit and other constitutive members (not shown), and along with the body, this constitutes an image forming apparatus.

The process cartridge 700 is so designed that an IC tag (non-contact IC tag) 730 is fitted to the inner surface of the housing 725 thereof, and the inspection information previously determined relative to the electrophotographic photoreceptor 707 is written on the IC tag 730. The position at which the IC tag 730 is fitted is not specifically defined so far as it is not a bar to image formation. For example, it may be fitted to the electrophotographic photoreceptor 707. The inspection information data to be written on the IC tag include those mentioned hereinabove in the section of the electrophotographic photoreceptor of the invention, and the methods for their determination may be the same as those also mentioned hereinabove.

The process cartridge 700 includes the IC tag 730 with the inspection information about the electrophotographic photoreceptor 707 written thereon. Therefore, when this is mounted on an image forming apparatus that includes a control unit capable of reading the inspection information from the IC tag 730 and capable of controlling the image-forming conditions on the inspection information, then images of good quality can be stably obtained even though the characteristic parameters of the photoreceptor including the sensitivity, the charging characteristic and the direction of eccentricity thereof fluctuate or even though the characteristic parameters of the photoreceptor are changed owing to the design change of the photoreceptor. The process cartridge 730 may be applicable to any image forming apparatus, for example, to those shown in FIGS. 9 and 11 to 12.

As described with reference to the embodiments, there is provided an electrophotographic photoreceptor having a conductive supporting member and a photosensitive layer disposed on the conductive supporting member, which is equipped with a non-contact IC tag and wherein inspection information about predetermined characteristic parameters previously measured relative to the photoreceptor is written on the non-contact IC tag.

The non-contact IC tag is referred to as RFID (radiofrequency identification tag), and at present, it is a small IC chip having a size of about 0.4 mm square, in which information may be stored in IC. Generally not requiring a battery, the non-contact IC tag may receive a radio wave generated by a reader/writer and may generate an electric current owing to its mechanism of electromagnetic induction, and may be thereby driven. Accordingly, it may be small-sized and may be stuck to commercial products.

At present, data of from 64 bytes to hundreds bytes may be recorded on such a non-contact IC tag, and inspection information about predetermined characteristic parameters of an electrophotographic photoreceptor may be fully written on it. Since the non-contact IC tag enables radio-communication of data even though it is not in direct contact with an IC tag reader/writer, it may be used, for example, by inserting it inside a photoreceptor or in a flange. At present, the frequency utilized for radio-communication of data is 13.56 Mhz, 2.45 Ghz or 135 kHz, and there are known non-contact IC tags constituted for each frequency type. The non-contact IC tags attain radio-communication of data by utilizing an electromagnetic wave, and therefore they enable writing/reading data anywhere so far as they are set in a site into which an electromagnetic wave may run, even though they could not be seen from the outside. Regarding the communicable range thereof for data reading/writing on it, the non-contact IC tag of an electromagnetic induction system is within about 1 m, and that of a microwave system is within about 5 m.

Accordingly, when an IC tag reader/writer is built in an image forming apparatus, then a non-contact IC tag may be disposed anywhere in the image forming apparatus and the apparatus enables non-contact data reading/writing with it, and therefore it is possible to control the image-forming condition of the apparatus from the information based on the inspection information written on the tag.

Specifically, the electrophotographic photoreceptor is mounted on an image forming apparatus equipped with a control unit capable of reading the inspection information written on the non-contact IC tag and capable of controlling the image-forming condition of the apparatus based on the inspection information. Accordingly, even when the photoreceptor has undergone fluctuation of its characteristic parameters such as the sensitivity, the charging characteristic and the direction of eccentricity thereof, or even when the characteristic parameters of the photoreceptor are changed owing to the design change thereof, the inspection information of the photoreceptor can be read from the non-contact IC tag and therefore an image-forming condition suitable to the photoreceptor can be readily and automatically set. As a result, the apparatus enables stable formation of images of good quality.

There is also provided a process cartridge including an electrophotographic photoreceptor having a conductive supporting member and a photosensitive layer disposed on the conductive supporting member, and at least one selected from a charging unit for charging the electrophotographic photoreceptor, a developing unit for developing an electrostatic latent image formed on the electrophotographic photoreceptor, with a toner to form a toner image, and a cleaning unit for removing the toner that remains on the surface of the electrophotographic photoreceptor; which is equipped with a non-contact IC tag and wherein inspection information about predetermined characteristic parameters previously measured relative to the electrophotographic photoreceptor is written on the non-contact IC tag.

The process cartridge of the type is mounted on an image forming apparatus equipped with a control unit capable of reading the inspection information written on the non-contact IC tag and capable of controlling the image-forming condition of the apparatus based on the inspection information. Accordingly, even when the photoreceptor has undergone fluctuation of its characteristic parameters such as the sensitivity, the charging characteristic and the direction of eccentricity thereof, or even when the characteristic parameters of the photoreceptor are changed owing to the design change thereof, the inspection information of the photoreceptor can be read from the non-contact IC tag and therefore an image-forming condition suitable to the photoreceptor can be readily and automatically set. As a result, the apparatus enables stable formation of images of good quality.

In the process cartridge, the position in which the non-contact IC tag is fitted is not specifically defined. For example, the tag may be fitted to the photoreceptor in the process cartridge or may be fitted to the casing of the process cartridge.

In the electrophotographic photoreceptor and the process cartridge, it is desirable that inspection information about a reference position on the peripheral surface of the photoreceptor and about the predetermined characteristic parameters at a predetermined position is written on the non-contact IC tag.

Since the non-contact IC tag has the information relating to a reference position and specific parameters at a predetermined position, an image-forming condition most suitable to any predetermined position of the photoreceptor may be set. When plural electrophotographic photoreceptors are mounted on one image forming apparatus and when the characteristic parameters include information data relating to the direction of eccentricity of each photoreceptor, then the registration for unifying the direction of eccentricity of every photoreceptor at the same image-forming position can be readily and automatically effected. As a result, images of good quality with no color unevenness can be stably formed.

The characteristic parameter may include at least one selected from a group of a film thickness of the photosensitive layer, a charging characteristic, current-voltage characteristic (I-V characteristic), a dark decay characteristic, a sensitivity, a surface roughness, a light reflectance, a direction of eccentricity, a hardness, and an abrasion resistance of the photosensitive layer.

There is further provided an image forming apparatus including the electrophotographic photoreceptor of the invention, a charging unit for charging the electrophotographic photoreceptor, an exposing unit for forming an electrostatic latent image on the electrophotographic photoreceptor, a developing unit for developing the electrostatic latent image formed on the electrophotographic photoreceptor, with a toner to form a toner image, a transfer unit for transferring the toner image onto a transfer medium, and a control unit for reading the inspection information written on the non-contact IC tag and controlling the image-forming condition on the basis of the inspection information.

Since the image forming apparatus includes the electrophotographic photoreceptor of the invention, the inspection information about the characteristic parameters of the photoreceptor can be read from the non-contact IC tag and the image-forming condition can be controlled on the basis of the inspection information. Accordingly, even when the photoreceptor has undergone fluctuation of its characteristic parameters such as the sensitivity, the charging characteristic and the direction of eccentricity thereof, or even when the characteristic parameters of the photoreceptor are changed owing to the design change thereof, the image-forming condition of the apparatus can be controlled in accordance with the characteristic parameters intrinsic to the photoreceptor and the apparatus therefore enables stable formation of images of good quality.

Preferably, the image forming apparatus of the invention includes a plurality of the electrophotographic photoreceptors of the invention, wherein each electrophotographic photoreceptor includes the conductive supporting member formed in a cylindrical shape and the photosensitive layer disposed on the conductive supporting member, the inspection information includes information about the direction of eccentricity of the electrophotographic photoreceptor, and the control unit is to control the image-forming condition on the basis of the inspection information so that the direction of eccentricity of every electrophotographic photoreceptor may be unified within a dislocation angle of at most 10 degrees at the same image-forming position. The condition in which the direction of eccentricity of every electrophotographic photoreceptor is unified within a dislocation angle of at most 10 degrees at the same image-forming position means, in other words, that any two of the electrophotographic photoreceptors are so positioned that the angle formed by the direction of eccentricity of one photoreceptor and that of another photoreceptor at the same image-forming position may be at most 10 degrees.

For example, when the image forming apparatus of the type of the invention is applied, for example, to a tandem-type color image forming apparatus, then the registration for unifying the direction of eccentricity of every photoreceptor at the same image-forming position can be effected easily and automatically, and therefore occurrence of an image defect such as color unevenness can be reduced satisfactorily and images of good image quality can be stably formed. In addition, even in repeated image formation, the direction of eccentricity of each photoreceptor can be periodically confirmed by the control unit to attain periodic registration, whereby the direction of eccentricity of each photoreceptor can be readily and automatically unified at the same image-forming position and occurrence of an image defect such as color unevenness can be satisfactorily reduced for a long period of time. In addition, since the direction of eccentricity of each photoreceptor is efficiently unified at the same image-forming position, it is desirable that each photoreceptor is independently rotatable and drivable.

The image-forming condition concretely includes the charge level by the charging unit, the exposure level by the exposing unit, the development bias by the developing unit, and, when the apparatus has plural photoreceptors, the registration for unifying the direction of eccentricity of each photoreceptor. The image-forming condition including any of these is controlled on the basis of the inspection information intrinsic to the photoreceptor, which is read from the non-contact IC tag, whereby images of good quality can be formed stably.

As described above, there is provided an electrophotographic photoreceptor and a process cartridge for constituting an image forming apparatus capable of stably forming images of good quality even when the quality such as the sensitivity, the charging characteristic and the direction of eccentricity of the photoreceptor therein has changed or even when the characteristics of the photoreceptor are changed owing to the design change thereof, and provides such an image forming apparatus.

Although the present invention has been shown and described with reference to the embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electrophotographic photoreceptor comprising:

a cylindrical conductive supporting member;

a photosensitive layer that is disposed on the cylindrical conductive supporting member;

a non-contact IC tag that retains inspection information including a previously measured characteristic parameter of the electrophotographic photoreceptor;

a photoreceptor drum that is provided with the cylindrical conductive supporting member and the photosensitive layer; and a flange that is disposed at an end portion of the photoreceptor drum, and is provided with the non-contact IC tag, wherein the characteristic parameter includes at least one selected from a group consisting of a film thickness of the photosensitive layer, a charging characteristic, current-voltage characteristic, a dark decay characteristic, a sensitivity, a surface roughness, a light reflectance, a direction of eccentricity, a hardness, and an abrasion resistance of the photosensitive layer.

2. The electrophotographic photoreceptor according to claim 1, wherein the inspection information includes:

a reference position on a peripheral surface of the electrophotographic photoreceptor; and the characteristic parameter that is previously measured at a predetermined position.

3. A process cartridge comprising:

an electrophotographic photoreceptor that includes a cylindrical conductive supporting member and a photosensitive layer that is disposed on the cylindrical conductive supporting member;

a photoreceptor drum that is provided with the cylindrical conductive supporting member and the photosensitive layer;

a non-contact IC tag that retains inspection information including a previously measured characteristic parameter of the electrophotographic photoreceptor;

a flange that is disposed at an end portion of the photoreceptor drum, and is provided with the non-contact IC tag; and at least one unit selected from a group consisting of:

a charging unit that charges the electrophotographic photoreceptor;

a developing unit that develops an electrostatic latent image formed on the electrophotographic photoreceptor with a toner to form a toner image; and a cleaning unit that removes the toner that remains on a surface of the electrophotographic photoreceptor, wherein the characteristic parameter includes at least one selected from a group consist of a film thickness of the photosensitive layer, a charging characteristic, current-voltage characteristic, a dark decay characteristic, a sensitivity, a surface roughness, a light reflectance, a direction of eccentricity, a hardness, and an abrasion resistance of the photosensitive layer.

4. The process cartridge according to claim 3, wherein the inspection information includes:

a reference position on a peripheral surface of the electrophotographic photoreceptor; and the characteristic parameter that is previously measured at a predetermined position.

5. An image forming apparatus comprising:

an electrophotographic photoreceptor that includes:

a cylindrical conductive supporting member;

a photosensitive layer that is disposed on the conductive supporting member; and a non-contact IC tag that retains inspection information including a previously measured characteristic parameter of the electrophotographic photoreceptor;

a photoreceptor drum that is provided with the cylindrical conductive supporting member and the photosensitive layer;

a flange that is disposed at an end portion of the photoreceptor drum, and is provided with the non-contact IC tag;

a charging unit that charges the electrophotographic photoreceptor;

an exposing unit that forms an electrostatic latent image on the electrophotographic photoreceptor;

a developing unit that develops an electrostatic latent image formed on the electrophotographic photoreceptor with a toner to form a toner image;

a transfer unit that transfers the toner image onto a transfer medium; and a control unit that reads the inspection information retained on the non-contact IC tag and controls an image forming condition on the basis of the inspection information, wherein the characteristic parameter includes at least one selected from a group consisting of a film thickness of the photosensitive layer, a charging characteristic, current-voltage characteristic, a dark decay characteristic, a sensitivity, a surface roughness, a light reflectance, a direction of eccentricity, a hardness, and an abrasion resistance of the photosensitive layer.

6. The image forming apparatus according to claim 5, wherein the image forming apparatus is provided with a plurality of the electrophotographic photoreceptors, the inspection information retained in each of the non-contact IC tags includes a direction of eccentricity of the respective electrophotographic photoreceptors as the characteristic parameter, and the control unit controls the image forming condition on the basis of the inspection information so that the direction of eccentricity of all of the electrophotographic photoreceptors is unified within a dislocation angle of at most 10 degrees at a same image-forming position.

* * * * *